US010563876B2

(12) United States Patent
Klein et al.

(10) Patent No.: US 10,563,876 B2
(45) Date of Patent: Feb. 18, 2020

(54) SETUP ROUTINE TO FACILITATE USER SETUP OF AN HVAC CONTROLLER

(71) Applicant: Ademco Inc., Golden Valley, MN (US)

(72) Inventors: Aaron J. Klein, Rochester, MN (US); Jeffrey Boll, Brooklyn Center, MN (US); Paul Derby, Lubbock, TX (US); Heidi J. Finch, Champlin, MN (US); Dan Murr, Mounds View, MN (US)

(73) Assignee: Ademco Inc., Golden Valley, MN (US)

( * ) Notice: Subject to any disclaimer, the term of this patent is extended or adjusted under 35 U.S.C. 154(b) by 543 days.

(21) Appl. No.: 14/088,268

(22) Filed: Nov. 22, 2013

(65) Prior Publication Data

US 2015/0148963 A1 May 28, 2015

(51) Int. Cl.
*F24F 11/30* (2018.01)

(52) U.S. Cl.
CPC ..... *F24F 11/30* (2018.01)

(58) Field of Classification Search
CPC ..... F24F 11/0009; F24F 2011/0064; F24F 2011/0061; F24F 2011/0091
USPC ..... 700/276
See application file for complete search history.

(56) References Cited

U.S. PATENT DOCUMENTS

| | | | |
|---|---|---|---|
| 4,079,366 | A | 3/1978 | Wong |
| 4,174,807 | A | 11/1979 | Smith et al. |
| 4,206,872 | A | 6/1980 | Levine |
| 4,224,615 | A | 9/1980 | Penz et al. |
| 4,264,034 | A | 4/1981 | Hyltin et al. |
| 4,298,946 | A | 11/1981 | Hartsell et al. |
| 4,308,991 | A | 1/1982 | Peinetti et al. |
| 4,337,822 | A | 7/1982 | Hyltin et al. |
| 4,382,544 | A | 5/1983 | Stewart et al. |
| 4,386,649 | A | 6/1983 | Hines et al. |
| 4,388,692 | A | 6/1983 | Jones et al. |
| 4,431,134 | A | 2/1984 | Hendricks et al. |
| 4,442,972 | A | 4/1984 | Sahay et al. |
| 4,446,913 | A | 5/1984 | Krocker et al. |
| 4,479,604 | A | 10/1984 | Didner et al. |
| 4,506,827 | A | 3/1985 | Jamieson et al. |
| 4,606,401 | A | 8/1986 | Levine et al. |

(Continued)

FOREIGN PATENT DOCUMENTS

| | | |
|---|---|---|
| DE | 3334117 | 4/1985 |
| EP | 0434926 | 7/1991 |

(Continued)

OTHER PUBLICATIONS

Nest, "Checking Compatibility for Nest Learning Thermostat", Oct. 2, 2012, Youtube.*

(Continued)

*Primary Examiner* — Thomas C Lee
*Assistant Examiner* — Michael Tang
(74) *Attorney, Agent, or Firm* — Shumaker & Sieffert, P.A.

(57) ABSTRACT

An HVAC controller may be programmed to execute a guided set up routine that may guide a user through configuring the thermostat to control a particular HVAC system configuration based, at least in part, on which wires from the HVAC system are connected to terminals of the HVAC controller. The guided set-up routine may be accessible through a user interface provided at a remote device that a user may utilize to interact with the HVAC controller from a remote location.

15 Claims, 18 Drawing Sheets

(56) References Cited

U.S. PATENT DOCUMENTS

| | | | |
|---|---|---|---|
| 4,621,336 | A | 11/1986 | Brown |
| 4,622,544 | A | 11/1986 | Bially et al. |
| 4,717,333 | A | 1/1988 | Carignan |
| 4,725,001 | A | 2/1988 | Carney et al. |
| 4,819,714 | A | 4/1989 | Otsuka et al. |
| 4,837,731 | A | 6/1989 | Levine et al. |
| 4,881,686 | A | 11/1989 | Mehta |
| 4,918,439 | A | 4/1990 | Wozniak et al. |
| 4,948,040 | A | 8/1990 | Kobayashi et al. |
| 4,992,779 | A | 2/1991 | Sugino et al. |
| 4,997,029 | A | 3/1991 | Otsuka et al. |
| 5,012,973 | A | 5/1991 | Dick et al. |
| 5,038,851 | A | 8/1991 | Mehta |
| 5,053,752 | A | 10/1991 | Epstein et al. |
| 5,065,813 | A | 11/1991 | Berkeley et al. |
| 5,086,385 | A | 2/1992 | Launey et al. |
| 5,088,645 | A | 2/1992 | Bell |
| 5,140,310 | A | 8/1992 | Deluca et al. |
| 5,161,606 | A | 11/1992 | Berkeley et al. |
| 5,170,935 | A | 12/1992 | Federspiel et al. |
| 5,181,653 | A | 1/1993 | Foster et al. |
| 5,187,797 | A | 2/1993 | Nielsen et al. |
| 5,230,482 | A | 7/1993 | Ratz et al. |
| 5,238,184 | A | 8/1993 | Adams |
| 5,251,813 | A | 10/1993 | Kniepkamp |
| 5,259,445 | A | 11/1993 | Pratt et al. |
| 5,329,991 | A | 7/1994 | Mehta et al. |
| 5,348,078 | A | 9/1994 | Dushane et al. |
| 5,386,577 | A | 1/1995 | Zenda et al. |
| 5,482,209 | A | 1/1996 | Cochran |
| 5,526,422 | A | 6/1996 | Keen |
| 5,537,106 | A | 7/1996 | Mitsuhashi et al. |
| 5,544,036 | A | 8/1996 | Brown, Jr. et al. |
| 5,566,879 | A | 10/1996 | Longtin et al. |
| 5,570,837 | A | 11/1996 | Brown et al. |
| 5,673,850 | A | 10/1997 | Uptegraph et al. |
| 5,682,206 | A | 10/1997 | Wehmeyer et al. |
| 5,761,083 | A | 6/1998 | Brown, Jr. et al. |
| 5,782,296 | A | 7/1998 | Mehta |
| 5,818,428 | A | 10/1998 | Eisenbrandt et al. |
| 6,351,693 | B1 | 2/2002 | Monie et al. |
| 6,398,118 | B1 | 6/2002 | Rosen et al. |
| 6,453,687 | B2 | 9/2002 | Sharood et al. |
| 6,478,233 | B1 | 11/2002 | Shah |
| 6,502,758 | B2 | 1/2003 | Cottrell |
| 6,518,957 | B1 | 2/2003 | Lehtinen et al. |
| 6,578,770 | B1 | 6/2003 | Rosen |
| 6,580,950 | B1 | 6/2003 | Johnson et al. |
| 6,581,846 | B1 | 6/2003 | Rosen |
| 6,595,430 | B1 | 7/2003 | Shah |
| 6,619,555 | B2 | 9/2003 | Rosen |
| 6,621,507 | B1 | 9/2003 | Shah |
| 6,783,079 | B2 | 8/2004 | Carey et al. |
| 6,786,421 | B2 | 9/2004 | Rosen |
| 6,789,739 | B2 | 9/2004 | Rosen |
| 6,824,069 | B2 | 11/2004 | Rosen |
| 6,833,990 | B2 | 12/2004 | LaCroix et al. |
| 6,851,621 | B1 | 2/2005 | Wacker |
| 6,891,838 | B1 | 5/2005 | Petite et al. |
| 6,967,565 | B2 | 11/2005 | Lingemann |
| 7,001,495 | B2 | 2/2006 | Essalik et al. |
| 7,050,026 | B1 | 5/2006 | Rosen |
| 7,146,253 | B2 | 12/2006 | Knobloch et al. |
| 7,152,806 | B1 | 12/2006 | Rosen |
| 7,156,318 | B1 | 1/2007 | Rosen |
| 7,181,317 | B2 | 2/2007 | Amundson et al. |
| 7,240,289 | B2 | 7/2007 | Naughton et al. |
| 7,246,087 | B1 | 7/2007 | Ruppelt et al. |
| 7,302,642 | B2 | 11/2007 | Smith et al. |
| 7,634,504 | B2 | 12/2009 | Amundson |
| 8,170,720 | B2 | 5/2012 | Amundson et al. |
| 8,219,251 | B2 | 7/2012 | Amundson et al. |
| 8,219,258 | B1 | 7/2012 | Almeida et al. |
| 8,606,409 | B2 | 12/2013 | Amundson et al. |
| 9,477,239 | B2 | 10/2016 | Bergman et al. |
| 2001/0029585 | A1 | 10/2001 | Simon et al. |
| 2001/0052459 | A1 | 12/2001 | Essalik et al. |
| 2002/0022991 | A1 | 2/2002 | Sharood et al. |
| 2002/0092779 | A1 | 7/2002 | Essalik et al. |
| 2003/0034897 | A1 | 2/2003 | Shamoon et al. |
| 2003/0034898 | A1 | 2/2003 | Shamoon et al. |
| 2005/0145705 | A1* | 7/2005 | Shah ..... G05D 23/1905 236/51 |
| 2007/0045441 | A1 | 3/2007 | Ashworth et al. |
| 2008/0133061 | A1* | 6/2008 | Hoglund ..... F24F 11/0012 700/277 |
| 2009/0062964 | A1 | 3/2009 | Sullivan et al. |
| 2009/0140056 | A1* | 6/2009 | Leen ..... F24F 11/0086 236/49.3 |
| 2010/0076605 | A1* | 3/2010 | Harrod ..... G05D 23/1905 700/276 |
| 2012/0239203 | A1 | 9/2012 | Amundson et al. |
| 2013/0087629 | A1 | 4/2013 | Stefanski et al. |
| 2013/0204440 | A1* | 8/2013 | Fadell ..... F24F 11/0086 700/276 |

FOREIGN PATENT DOCUMENTS

| | | |
|---|---|---|
| EP | 0678204 | 3/2000 |
| EP | 0985994 | 3/2000 |
| EP | 1074009 | 2/2001 |
| SL | 20556 | 10/2001 |
| WO | 9711448 | 3/1997 |
| WO | 9739392 | 10/1997 |
| WO | 0043870 | 7/2000 |
| WO | 0152515 | 7/2001 |
| WO | 0179952 | 10/2001 |

OTHER PUBLICATIONS

"A Full Range of Alternative User Interfaces For Building Occupants and Operators," http://www.automatedbuildings.com/news/jan00/articles/andover/andover.htm, 5 pages, dated Jan. 2000, printed Sep. 20, 2004.

"CorAccess Systems/In Home," http://web.archive.org/web20011212084427/www.coraccess.com/home.html, 1 page, copyright 2001, printed Aug. 19, 2004.

"High-Tech Options Take Hold in New Homes-200-08-28-Dallas Business Journal," http://bizjournals.com/dallas/stories/2000/08/28/focus4, 3 pages, dated Aug. 28, 2008, printed Aug. 19, 2004.

"Home Toys Review—TouchLinc," http://www.hometoys.com/htinews/aug99/reviews/touchlinc.htm, 3 pages, dated Aug. 1999, printed Aug. 20, 2004.

"Mark of Excellence Award Finalist Announced," http://64.233.167.104/search?Q=cache:ciOA2YtYaBIJ:www.hometoys.com/releases/mar . . . , 6 pages, Leopard Touchscreen on p. 2, dated prior to Mar. 4, 2000, printed Aug. 20, 2004.

"Product Review—Philips Pronto Remote Control," http://hometheaterhifi.com/volume_6_2/philipsprontoremotecontrol.html, 5 pages, dated May 1999, printed Aug. 20, 2004.

"RC X10 Automation Forum: Control Your Heating and Cooling System with Pronto (1/1)," http://www.remotecentral.com/cgi-bin/mboard/rc-x10/thread.cgi?12, 2 pages, dated Apr. 23, 1999, printed Aug. 20, 2004.

"Spotlight on Integrated Systems," Custom Builder, V8, N2, p. 66(6), Mar.-Apr. 1993.

"Vantage Expands Controls for Audio/Video, HVAC and Security," http://www.Hometoys.com/htinews/aug99/realease/vantage03.htm, 2 pages, dated Aug. 3, 1999, printed Aug. 20, 2004.

Adi, "Leopard User Manual," 93 pages, 2001.

Adicon 2500, "The Automator," 4 pages, Oct.-Dec. 2000.

ADT Security Services, "iCenter Advanced User Interface 8142ADT," Installation and Setup Guide, 5 pages, May 2001; First Sale Feb. 2001.

ADT Security Systems, "iCenter Advanced User Interface 8142ADT User Guide," pp. 1-136, 2001.

Aprilaire Electronic Thremostats Models 8344, 8346, 8348, 8363, 8365, 8366 Operating Instructions, 8 pages, prior to Dec. 2, 2003.

(56) References Cited

OTHER PUBLICATIONS

Aube Technologies, Electronic Thermostat for Heating System Model TH135-01, 5 pages, Aug. 14, 2001.
Aube Technologies, TH140-28 Electronic Programmable Thermostat, Installation Instructions and User Guide, pp. 1-4, Jan. 22, 2004.
Blake et al., "Seng 310 Final Project Demo Program," Illustration, 3 pages, Apr. 6, 2001.
Blake et al., "Seng 310 Final Project," Report, dated Apr. 6, 2001.
Blister Pack Insert from a Ritetemp 8082 Touch Screen Thermostat Product, 2 pages, 2002.
Braeburn Model 3000 Owner's Manual, pp. 1-13, 2001.
Braeburn Model 5000 Owner's Manual, pp. 1-17, 2001.
BRK Electronics Maximum Protection Plus Ultimate Convenience Smoke Alarm, 24 pages, prior to Dec. 2, 2003.
BRK First Alert, User's Manual, Smoke and Fire Alarms, pp. 1-7, Nov. 2002.
Business Wire, "MicroTouch Specialty Products Group to Capitalize on Growing Market for Low-Cost Digital Matrix Touchscreens,"pp. 1174 (2 pages), Jan. 6, 1999.
Bryant, "Installation and Start-Up Instructions Evolution Control SYSTXBBUID01," 12 pages, 2004.
Cardio Manual, available at http://www.secant.ca/en/documentation/cardio2é-Manual.pdf, Cardio Home Automation Inc., 55 pages, printed Sep. 28, 2004.
Cardio, by Secant; http://www.hometoys.com/htinews/apr98/reviews/cardio.htm, "HTINews Review," Feb. 1998, 5 pages, printed Sep. 14, 2004.
Carrier Microelectronic Programmable Thermostat Owner's Manual, pp. 1-24, May 1994.
Carrier TSTATCCRF01 Programmable Digital Thermostat, pp. 1-21, prior to Dec. 2, 2003.
Carrier, "Programmable Dual Fuel Thermostat," Installation, Start-Up & Operating Instructions, pp. 1-12, Oct. 1998.
Carrier, "Programmable Thermostats," Installation, Start-Up & Operating Instructions, pp. 1-16, Sep. 1998.
Carrier, "Standard Programmable Thermostat," Homeowner's Manual, pp. 1-8, 1998.
Carrier, "Thermidistat Control," Installation, Start-Up, and Operating Instructions, pp. 1-12, Aug. 1999.
Climatouch, User Manual, Climatouch CT03TSB Thermostat, Climatouch CT03TSHB Thermostat with Humididty Control, Outdoor UHF Temperature Transmitter 217S31, 19 pages, Printed Sep. 15, 2004.
File History for ReExam Control No. 95/002,041, U.S. Pat. No. 7,634,504, ReExamination Filed Jul. 18, 2012. (This reference will be uploaded in 4 parts).
CorAccess, "Companion 6," User Guide, pp. 1-20, Jun. 17, 2002.
Danfoss RT51/51 RF & RT52/52RF User Instructions, 2 pages, Jun. 2004.
DeKoven et al., "Designing Collaboration in Consumer Products," 2 pages, 2001.
DeKoven et al., "Measuring Task Models in Designing Intelligent Products," pp. 188-189, 2002.
Domotique Secant Home Automation-Web Page, available at http://www.secant.ca/en/company/default.asp, 1 page, printed Sep. 28, 2004.
Firex Smoke Alarm, Ionization Models AD, ADC Photoelectric Model Pad, 4 pages, prior to Dec. 2, 2003.
Freudenthal et al., "Communicating Extensive Smart Home Functionality to Users of All Ages: The Design of a Mixed-Initiative Multimodal Thermostat-Interface," pp. 34-39, Mar. 12-13, 2001.
Gentex Corporation, 9000 Series, Photoelectric Type Single Station/Multi-Station Smoke Alarms AC Powered with Battery Backup, Installation Instructions-Owner's Information, pp. 9-1 to 9-6, Jan. 1, 1993.
Gentex Corporation, HD135, 135° Fixed Temperature Heat Detector AC Powered, 120V, 60Hz with Battery Backup, Installation Instructions-Owner's Information, pp. 1-5, Jun. 1, 1998.
Honeywell Brivis Deluxe Programmable Thermostat, pp. 1-20, 2002.
Honeywell Brivis T8602C Chronotherm IV Deluxe Programmable Thermostats, Installation Instructions, pp. 1-12, 2002.
Honeywell CT8602C Professional Fuel Saver Thermostat, pp. 1-6, 1995.
Honeywell Electronic Programmable Thermostat, Owner's Guide, pp. 1-20, 2003.
Honeywell Electronic Programmable Thermostats, Installation Instructions, pp. 1-8, 2003.
Honeywell News Release, "Honeywell's New Sysnet Facilities Integration System for Boiler Plant and Combustion Safety Processes," 4 pages, Dec. 15, 1995.
Honeywell T8002 Programmable Thermostat, Installation Instructions, pp. 1-8, 2002.
Honeywell T8602 A, B, C, D and TS8602 A, C Chronotherm III Fuel Saver Thermostats, Installation Instructions, pp. 1-12, 1995.
Honeywell T8602D Chronotherm IV Deluxe Programmable Thermostats, Installation Instructions, pp. 1-12, 2002.
Honeywell TH8000 Series Programmable Thermostats, Owner's Guide, pp. 1-44, 2004.
Honeywell, "Excel Building Supervisor-Integrated R7044 and FS90 Ver. 2.0," Operator Manual, 70 pages, Apr. 1995.
Honeywell, "Introduction of the S7350A Honeywell WebPAD Information Appliance," Home and Building Control Bulletin, 2 pages, Aug. 29, 2000; Picture of Web Pad Device with touch Screen, 1 page; and screen shots of WebPad Device, 4 pages.
Honeywell, "Vision Pro 8000 Touchscreen Programmable Thermostat," Honeywell International Inc., 40 pages, 2004.
Honeywell, "W7006A Home Controller Gateway User Guide," 31 pages, Jul. 2001.
Honeywell, MagicStat® CT3200 Programmable Thermostat, Installation and Programming Instructions, pp. 1-24, 2001.
http://www.cc.gatech.edu/computing /classes/cs6751_94_fall/groupc/climate-2/node1.html, "Contents," 53 pages, printed Sep. 20, 2004.
http://www.hometoys.com/htinews/apr99/releases/hal01.htm, HTI News Release, pp. 1-3.
http://www.ritetemp.info/rtMenu_13.html, RiteTemp 8082, 6 pages, printed Jun. 20, 2003.
http://www.thermostatsales.com, Robershaw, "9610 Digital Programmable Thermostat," 3 pages, printed Jun. 17, 2004.
http://www.thermostatsales.com, Robershaw, "9700 Digital Programmable Thermostat," 3 pages, printed Jun. 17, 2004.
http://www.thermostatsales.com, Robershaw, "9710 Digital Programmable Thermostat," 3 pages, printed Jun. 17, 2004.
http://www.thermostatsales.com, Robershaw, "9720 Digital Programmable Thermostat," 3 pages, printed Jun. 17, 2004.
Hunter, "44200/44250," Owner's Manual, 32 pages, printed prior to Dec. 2, 2003.
Hunter, "44300/44350," Owner's Manual, 35 pages, printed prior to Dec. 2, 2003.
Hunter, "Auto Saver 550," Owner's Manual Model 44550, 44 pages, printed prior to Dec. 2, 2003.
Install Guide for Ritetemp Thermostat 8082, 6 pages, 2002.
Invensys Deluxe Programmable Thermostats 9700, 9701, 9715, 9720, User's Manual, 21 pages, prior to Dec. 2, 2003.
Lennox, "Network Control Panel (NCP)," User's Manual, 18 pages, Nov. 1999.
Lux TX9000 Installation, 3 pages, prior to Dec. 2, 2003.
Lux, "511 Series Smart Temp Electronic Thermostat," Owner's Manual, 3 pages, printed prior to Dec. 2, 2003.
Lux, "600 Series Smart Temp Electronic Thermostat," Owner's Manual, 3 pages, printed prior to Dec. 2, 2003.
Lux, "602 Series Multi-Stage Programmable Thermostat," Owner's Manual, 3 pages, printed prior to Dec. 2, 2003.
Lux, "605/2110 Series Programmable Heat Pump Thermostat," Owner's Manual, 3 pages, printed prior to Dec. 2, 2003.
Lux, "700/9000 Series Smart Temp Electronic Thermostat," Owner's Manual, 3 pages, printed prior to Dec. 2, 2003.
Lux, "ELV1 Programmable Line Voltage Thermostat," Owner's Manual, 3 pages, printed prior to Dec. 2, 2003.
Lux, "PSPH521 Series Programmable Heat Pump Thermostat," Owner's Manual, 3 pages, printed prior to Dec. 2, 2003.
Lux, "TX1500 Series Smart Temp Electronic Thermostat," Owner's Manual, 6 pages, printed prior to Dec. 2, 2003.

(56) References Cited

OTHER PUBLICATIONS

Lux, "TX500 Series Smart Temp Electronic Thermostat," Owner's Manual, 3 pages, printed prior to Dec. 2, 2003.
Metasys, "HVAC PRO for Window's User's Manual," 308 pages, 1998.
Mounting Template for Ritetemp Thermostat 8082, 1 page, 2002.
Operation manual for Ritetemp Touch Screen Thermostat 8082, 8 pages, 2002.
Proliphix Inc., "Web Enabled IP Thermostats," 2 pages, prior to Dec. 2, 2003.
Quick Start Guide for Ritetemp Thermostat 8082, 1 page, 2002.
Remote Control Power Requirement for Ritetemp Thermostat 8082, 1 page, 2002.
Ritetemp Operation 8029, 3 pages, Jun. 19, 2002.
Ritetemp Operation 8050, 5 pages, Jun. 26, 2002.
Ritetemp Operation 8085, pp. 1-6, prior to Dec. 2, 2003.
Sealed Unit Parts Co., Inc., Supco & CTC Thermostats . . . Loaded with Features, Designed for Value!, 6 pages, prior to Dec. 2, 2003.
Totaline Model P474-1035 Owner's Manual Programmable 5-2 Day Digital Thermostat, pp. 1-21, prior to Dec. 2, 2003.
Totaline Star CPE230RF, Commercial Programmable Thermostat Wireless Transmitter, Owner's Manual, pp. 1-16, Oct. 1998.
Totaline Star P/N P474-0130 Non-Programmable Digital Thermostat Owner's Manual, pp. 1-22, prior to Dec. 2, 2003.
Totaline, "1 For All Programmable Digital Thermostat," Owner's Manual P/N P374-1100FM, 23 pages, Nov. 1998.
Totaline, "1 For All Programmable Digital Thermostat," Owner's Manual P/N P474-1050, 21 pages, Nov. 1998.
Totaline, "1 For All Programmable Digital Thermostat," Owner's Manual P/N P374-1100, 24 pages, Apr. 2001.
Totaline, "Instructions P/N P474-1010," Manual, 2 pages, Dec. 1998.
Totaline, "Intellistat Combination Temperature and Humidity Control," Owner's Manual P/N P374-1600, 25 pages, Jun. 2001.
Totaline, "Programmable Thermostat Configurable for Advanced Heat Pump or Dual Fuel Operation," Owner's Manual P/N P374-1500, 24 pages, Jun. 1999.
Totaline, "Programmable Thermostat," Homeowner's Guide, 27 pages, Dec. 1998.
Totaline, "Wireless Programmable Digital Thermostat," Owner's Manual 474-1100RF, 21 pages, 2000.
Trane, "System Programming, Tracer Summit Version 14, BMTW-SVP01D-EN," 623 pages, 2002. (This reference will be uploaded in 3 parts).
Trouble Shooting Guide for Ritetemp Thermostat 8082, 1 page, 2002.
Visor Handheld User Guide, 280 pages, Copyright 1999-2000.
Warmly Yours, "Model TH111GFCI-P (120 VAC)," Manual, pp. 1-4, printed prior to Dec. 2, 2003.
White-Rodgers 1F80-224 Programmable Electronic Digital Thermostat, Installation and Operation Instructions, 8 pages, prior to Dec. 2, 2003.
White-Rodgers Installation Instructions for Heating & Air Conditioning IF78 Non-Programmable Thermostat, 6 pages, prior to Dec. 2, 2003.
White-Rodgers, "Comfort-Set 90 Series Thermostat," Manual, pp. 1-44, printed prior to Dec. 2, 2003.
White-Rodgers, "Comfort-Set III Thermostat," Manual, pp. 1-44, printed prior to Dec. 2, 2003.
White-Rodgers, "Installation Instructions for Heating & Air Conditioning IF72 5/2 Day Programmable Heat Pump Thermostat," 8 pages, printed prior to Dec. 2, 2003.
White-Rodgers, "Installation Instructions for Heating & Air Conditioning IF78 5/2 Day Programmable Thermostat," 7 pages, printed prior to Dec. 2, 2003.
White-Rodgers, Comfort-Set 90 Series Premium, 4 pages, prior to Dec. 2, 2003.
White-Rodgers, IF80-240 "(for Heating Only systems) Programmable Electronic Digital Thermostat," Installation and Operation Instructions, 8 pages, printed prior to Dec. 2, 2003.
White-Rodgers, IF80-241, "Programmable Electronic Digital Thermostat," Installation and Operation Instructions, 6 pages, printed prior to Mar. 29, 2012.
White-Rodgers, IF80-261, "Programmable Electronic Digital Thermostat," Installation and Operation Instructions, 8 pages, printed prior to Dec. 2, 2003.
White-Rodgers, IF81-261, "Programmable Electronic Digital Multi-Stage Thermostat," Installation and Operation Instructions, 8 pages, printed prior to Dec. 2, 2003.
White-Rodgers, IF82-261, "Programmable Electronic Digital Heat Pump Thermostat," Installation and Operation Instructions, 8 pages, prior to Dec. 2, 2003.
www.icmcontrols.com, Simplecomfort, SC3000 Single Stage Heat/Single Stage Cool or Single Stage Heat Pump/Manual Changeover, 1 page, printed prior to Dec. 2, 2003.
www.icmcontrols.com, Simplecomfort, SC3001 Single Stage Heat/Single Stage Cool or Single Stage Heat Pump/Manual Changeover, 1 page, printed prior to Dec. 2, 2003.
www.icmcontrols.com, Simplecomfort, SC3006 Single Stage Heat/Single Stage Cool or Single Stage Heat Pump/Manual Changeover, 1 page, printed prior to Dec. 2, 2003.
www.icmcontrols.com, Simplecomfort, SC3201 2 Stage Heat Pump Manual Changeover, 1 page, printed prior to Dec. 2, 2003.
www.icmcontrols.com, Simplecomfort, SC3801 2 Stage Heat/2 Stage Cool 2 Stage Heat Pump/Audio Changeover, 1 page, printed Dec. 2, 2003.
Action Closing Prosection for Reexam Control No. 95/002,041, Mailed Jul. 5, 2013.

* cited by examiner

SETUP ROUTINE TO FACILITATE USER SETUP OF AN HVAC CONTROLLER

TECHNICAL FIELD

This disclosure relates generally to HVAC systems, and more particularly, to HVAC controllers that may be used for controlling HVAC systems.

BACKGROUND

Heating, ventilation, and/or air conditioning (HVAC) systems are often used to control the comfort level within a building or other structure. Such HVAC systems typically include an HVAC controller that controls various HVAC components of the HVAC system in order to affect and/or control one or more environmental conditions within the building. In some cases, a user (typically a do-it-yourself homeowner) installing a new HVAC controller may have limited knowledge about the configuration of their existing HVAC system. This may present a challenge when configuring the new HVAC controller to control the various components of the existing HVAC system.

SUMMARY

This disclosure relates generally to HVAC systems, and more particularly, to HVAC controllers that may be used for controlling HVAC systems. In one illustrative embodiment, an HVAC controller configured to control one or more components of an HVAC system having a particular HVAC system configuration can include: a user interface including a display; a memory; and an output block for providing one or more control signals to the HVAC system. The output block can include a number or wiring terminals for accepting wires of the HVAC system. The wiring configuration between the wires of the HVAC system and the wiring terminals of the output block may be dependent on the particular HVAC system configuration of the HVAC system. When replacing an old HVAC controller with a new one, the wires that are available in the wall and/or were wired to the old HVAC controller provide information that may help determine the HVAC configuration of the HVAC system. The HVAC controller may further include a controller operatively coupled to the memory, the user interface and the output block. In some cases, the controller can be configured to display a guided-set up routine that includes two or more screens that guide a user to configure the new HVAC controller for controlling the particular HVAC system configuration of the HVAC system. At least one of the screens of the guided-set up routine can display a first selectable option and a second selectable option. The first selectable option may identify a first HVAC configuration setting and may further identify a first wiring configuration that corresponds to the first HVAC configuration setting. The second selectable option may identify a second HVAC configuration setting and may further identify a second wiring configuration that corresponds to the second HVAC configuration setting. In some cases, the first and second selectable options may be simultaneously displayed on a common screen.

In another illustrative embodiment, an HVAC controller configured to control one or more components of an HVAC system having a particular HVAC system configuration can include: a user interface including a display; a memory; and an output block for providing one or more control signals to the HVAC system. The output block can include a number or wiring terminals for accepting wires of the HVAC system. The wiring configuration between the wires of the HVAC system and the wiring terminals of the output block may be dependent on the particular HVAC system configuration of the HVAC system. The HVAC controller may further include a controller operatively coupled to the memory, the user interface and the output block. The controller may be configured to display one or more configuration screens used to configure the HVAC controller for controlling the particular HVAC system configuration, wherein at least one of the screens simultaneously displays a first selectable option and a second selectable option. The first selectable option may identify a first HVAC configuration setting, and the second selectable option may identify: (1) a second HVAC configuration setting; and (2) a wiring configuration that corresponds to the second HVAC configuration setting. In some instances, the first selectable option may also identify a wiring configuration that corresponds to the first HVAC configuration setting.

In another illustrative embodiment, an HVAC controller configured to control one or more components of an HVAC system having a particular HVAC system configuration can include: a user interface including a display; a memory; and an output block for providing one or more control signals to the HVAC system. The output block can include a number or wiring terminals for accepting wires of the HVAC system. In some cases, the wiring configuration between the wires of the HVAC system and the wiring terminals of the output block is dependent on the particular HVAC system configuration of the HVAC system. The HVAC controller may further include a controller operatively coupled to the memory, the user interface and the output block. The controller can be configured to display a guided-set up routine on the display having two or more screens that guide a user to configure the HVAC controller to control the particularly HVAC system configuration of the HVAC system. The guided-set up routine may solicit information from a user related to an equipment type contained in the particular HVAC system configuration as well information regarding the wiring configuration used by the user to wire the HVAC system to the wiring terminals of the output block of the HVAC controller. The controller can be configured to use the information related to the equipment type contained in the particular HVAC system configuration as well the information regarding the wiring configuration used by the user to wire the HVAC system to the wiring terminals of the output block to configure the HVAC controller to control the particular HVAC system configuration of the HVAC system.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments in connection with the accompanying drawings, in which.

Figure 1:
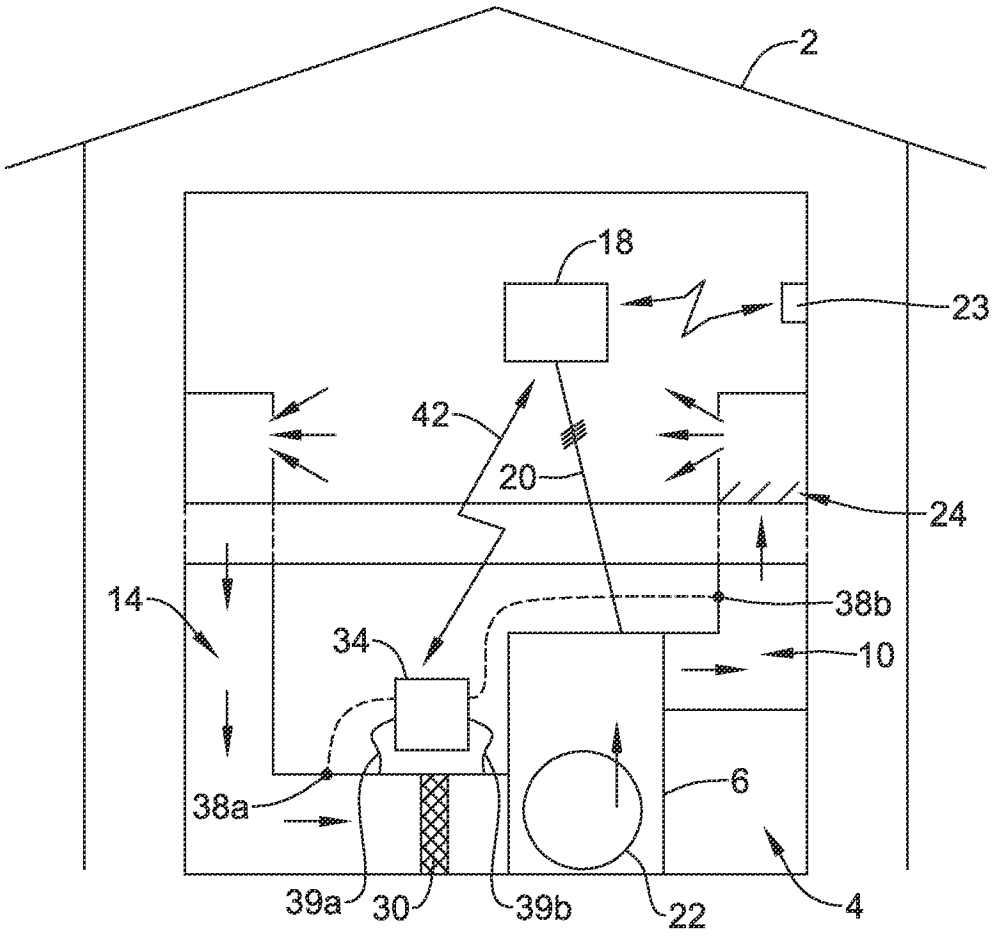
FIG. 1 is a schematic view of an illustrative HVAC system servicing a building or structure.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several embodiments which are meant to illustrative in nature.

FIG. 1 is a schematic view of a building 2 having an illustrative heating, ventilation, and air conditioning (HVAC) system 4. While FIG. 1 shows a typical forced air type HVAC system, other types of HVAC systems are contemplated including, but not limited to, boiler systems, radiant heating systems, electric heating systems, cooling systems, heat pump systems, and/or any other suitable type of HVAC system, as desired. The illustrative HVAC system 4 of FIG. 1 includes one or more HVAC components 6, a system of ductwork and air vents including a supply air duct 10 and a return air duct 14, and one or more HVAC controllers 18. The one or more HVAC components 6 may include, but are not limited to, a furnace, a heat pump, an electric heat pump, a geothermal heat pump, an electric heating unit, an air conditioning unit, a humidifier, a dehumidifier, an air exchanger, an air cleaner, a damper, a valve, and/or the like.

It is contemplated that the HVAC controller(s) 18 may be configured to control the comfort level in the building or structure by activating and deactivating the HVAC component(s) 6 in a controlled manner. The HVAC controller(s) 18 may be configured to control the HVAC component(s) 6 via a wired or wireless communication link 20. When the communication link 20 is a wired communication link, the wiring configuration between the wires of the HVAC system 4 and the wiring terminals of the HVAC controller 18 will be dependent on the particular HVAC system configuration of the HVAC system 4. When replacing an old HVAC controller 18 with a new one, the wires that are available in the wall and/or were wired to the old HVAC controller may provide information that may help determine the HVAC configuration of the HVAC system 4.

In some cases, the HVAC controller(s) 18 may be a thermostat, such as, for example, a wall mountable thermostat, but this is not required in all embodiments. Such a thermostat may include (e.g. within the thermostat housing) or have access to a temperature sensor for sensing an ambient temperature at or near the thermostat. In some instances, the HVAC controller(s) 18 may be a zone controller, or may include multiple zone controllers each monitoring and/or controlling the comfort level within a particular zone in the building or other structure.

In the illustrative HVAC system 4 shown in FIG. 1, the HVAC component(s) 6 may provide heated air (and/or cooled air) via the ductwork throughout the building 2. As illustrated, the HVAC component(s) 6 may be in fluid communication with every room and/or zone in the building 2 via the ductwork 10 and 14, but this is not required. In operation, when a heat call signal is provided by the HVAC controller(s) 18, an HVAC component 6 (e.g. forced warm air furnace) may be activated to supply heated air to one or more rooms and/or zones within the building 2 via supply air ducts 10. The heated air may be forced through supply air duct 10 by a blower or fan 22. In this example, the cooler air from each zone may be returned to the HVAC component 6 (e.g. forced warm air furnace) for heating via return air ducts 14. Similarly, when a cool call signal is provided by the HVAC controller(s) 18, an HVAC component 6 (e.g. air conditioning unit) may be activated to supply cooled air to one or more rooms and/or zones within the building or other structure via supply air ducts 10. The cooled air may be forced through supply air duct 10 by the blower or fan 22. In this example, the warmer air from each zone may be returned to the HVAC component 6 (e.g. air conditioning unit) for cooling via return air ducts 14. In some cases, the HVAC system 4 may include an internet gateway or other device 23 that may allow one or more of the HVAC components, as described herein, to communicate over a wide area network (WAN) such as, for example, the Internet.

In some cases, the system of vents or ductwork 10 and/or 14 can include one or more dampers 24 to regulate the flow of air, but this is not required. For example, one or more dampers 24 may be coupled to one or more HVAC controller(s) 18, and can be coordinated with the operation of one or more HVAC components 6. The one or more HVAC controller(s) 18 may actuate dampers 24 to an open position, a closed position, and/or a partially open position to modulate the flow of air from the one or more HVAC components to an appropriate room and/or zone in the building or other structure. The dampers 24 may be particularly useful in zoned HVAC systems, and may be used to control which zone(s) receives conditioned air from the HVAC component(s) 6.

In many instances, one or more air filters 30 may be used to remove dust and other pollutants from the air inside the building 2. In the illustrative example shown in FIG. 1, the air filter(s) 30 is installed in the return air duct 14, and may filter the air prior to the air entering the HVAC component 6, but it is contemplated that any other suitable location for the air filter(s) 30 may be used. The presence of the air filter(s) 30 may not only improve the indoor air quality, but may also protect the HVAC components 6 from dust and other particulate matter that would otherwise be permitted to enter the HVAC component.

In some cases, and as shown in FIG. 1, the illustrative HVAC system 4 may include an equipment interface module (EIM) 34. When provided, the equipment interface module 34 may be configured to measure or detect a change in a given parameter between the return air side and the discharge air side of the HVAC system 4. For example, the equipment interface module 34 may be adapted to measure a difference in temperature, flow rate, pressure, or a combination of any one of these parameters between the return air side and the discharge air side of the HVAC system 4. In some cases, the equipment interface module 34 may be adapted to measure the difference or change in temperature (delta T) between a return air side and discharge air side of the HVAC system 4 for the heating and/or cooling mode. The delta T for the heating mode may be calculated by subtracting the return air temperature from the discharge air temperature (e.g. delta T=discharge air temp.–return air temp.). For the cooling mode, the delta T may be calculated by subtracting the discharge air temperature from the return air temperature (e.g. delta T=return air temp.–discharge air temp.).

In some cases, the equipment interface module 34 may include a first temperature sensor 38*a* located in the return (incoming) air duct 14, and a second temperature sensor 38*b* located in the discharge (outgoing or supply) air duct 10. Alternatively, or in addition, the equipment interface module 34 may include a differential pressure sensor including a first pressure tap 39*a* located in the return (incoming) air duct 14, and a second pressure tap 39*b* located downstream of the air filter 30 to measure a change in a parameter related to the amount of flow restriction through the air filter 30. In some cases, the equipment interface module 34, when provided, may include at least one flow sensor that is capable of providing a measure that is related to the amount of air flow restriction through the air filter 30. In some cases, the equipment interface module 34 may include an air filter monitor. These are just some examples.

When provided, the equipment interface module 34 may be configured to communicate with the HVAC controller 18 via, for example, a wired or wireless communication link 42. In other cases, the equipment interface module 34 may be incorporated or combined with the HVAC controller 18. In either cases, the equipment interface module 34 may communicate, relay or otherwise transmit data regarding the selected parameter (e.g. temperature, pressure, flow rate, etc.) to the HVAC controller 18. In some cases, the HVAC controller 18 may use the data from the equipment interface module 34 to evaluate the system's operation and/or performance. For example, the HVAC controller 18 may compare data related to the difference in temperature (delta T) between the return air side and the discharge air side of the HVAC system 4 to a previously determined delta T limit stored in the HVAC controller 18 to determine a current operating performance of the HVAC system 4.

Figure 2:
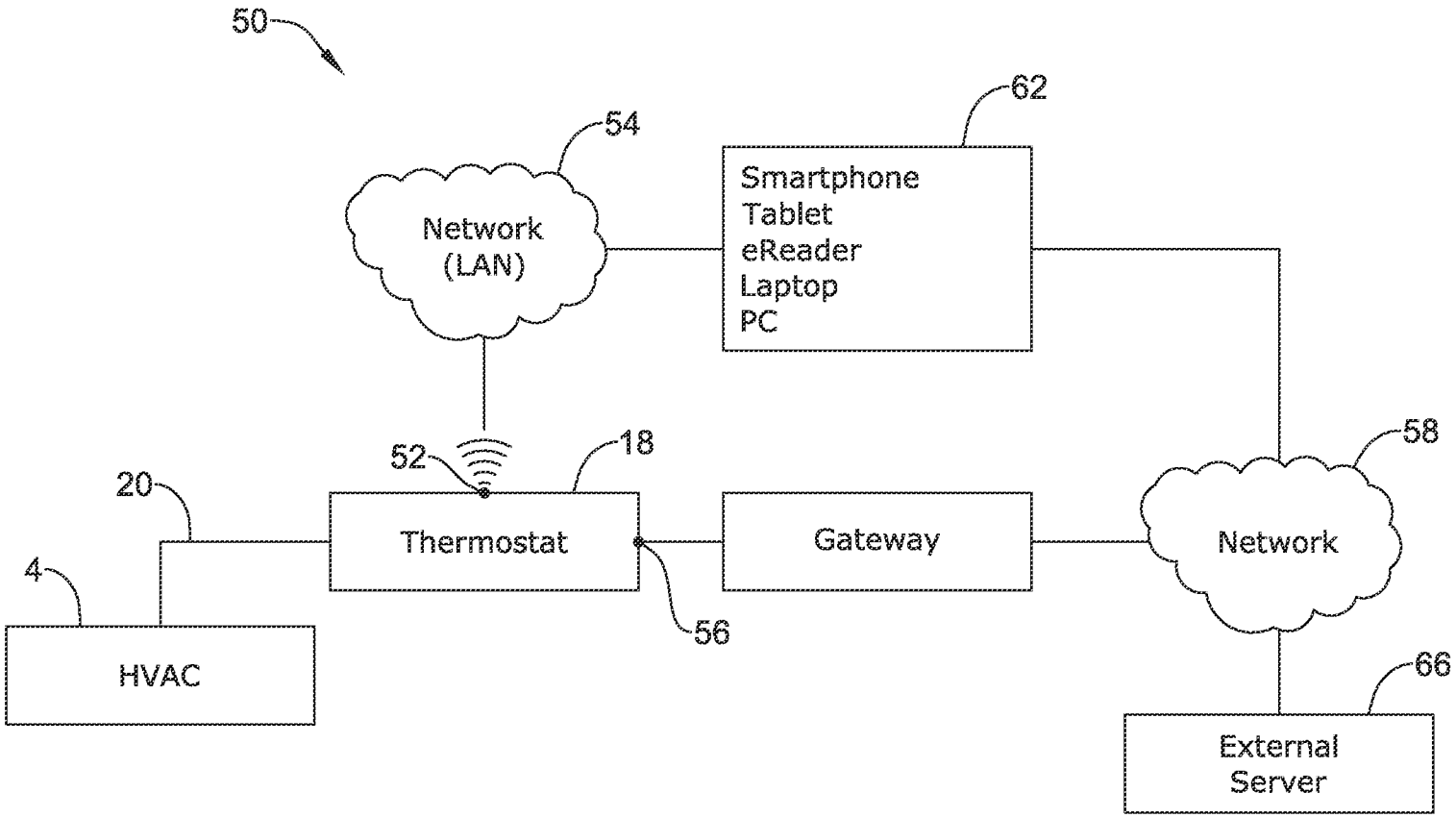
FIG. 2 is a schematic view of an illustrative HVAC control system that may facilitate access and/or control of the HVAC system of FIG. 1.

FIG. 2 is a schematic view of an HVAC control system 50 that facilitates remote access and/or control of the HVAC system 4 shown in FIG. 1, when desired. The illustrative HVAC control system 50 includes an HVAC controller, as for example, HVAC controller 18 (see FIG. 1) that is configured to communicate with and control one or more components 6 of the HVAC system 4. As discussed above, the HVAC controller 18 may communicate with the one or more components 6 of the HVAC system 4 via a wired or wireless link 20. Additionally, the HVAC controller 18 may be adapted to communicate over one or more wired or wireless networks that may accommodate remote access and/or control of the HVAC controller 18 via another device such as a smart phone, tablet, e-reader, laptop computer, personal computer, key fob, or the like. As shown in FIG. 2, the HVAC controller 18 may include a first communications port 52 for communicating over a first network 54, and in some cases, a second communications port 56 for communicating over a second network 58. In some cases, the first network 54 may be a wireless local area network (LAN), and the second network 58 (when provided) may be a wide area network or global network (WAN) including, for example, the Internet. In some cases, the wireless local area network 54 may provide a wireless access point and/or a network host device that is separate from the HVAC controller 18. In other cases, the wireless local area network 54 may provide a wireless access point and/or a network host device that is part of the HVAC controller 18. In some cases, the wireless local area network 54 may include a local domain name server (DNS), but this is not required for all embodiments. In some cases, the wireless local area network 54 may be an ad-hoc wireless network, but this is not required.

In some cases, the HVAC controller 18 may be programmed to communicate over the second network 58 with an external web service hosted by one or more external web servers 66. A non-limiting example of such an external web service is Honeywell's TOTAL CONNECT™ web service. The HVAC controller 18 may be configured to upload selected data via the second network 58 to the external web service where it may be collected and stored on the external web server 66. In some cases, the data may be indicative of the performance of the HVAC system 4. Additionally, the HVAC controller 18 may be configured to receive and/or download selected data, settings and/or services including software updates from the external web service over the second network 58. The data, settings and/or services may be received automatically from the web service, downloaded periodically in accordance with a control algorithm, and/or downloaded in response to a user request. In some cases, for example, the HVAC controller 18 may be configured to receive and/or download an HVAC operating schedule and operating parameter settings such as, for example, temperature set points, humidity set points, start times, end times, schedules, window frost protection settings, and/or the like from the web server 66 over the network 58. In some instances, the HVAC controller 18 may be configured to receive one or more user profiles having at least one operational parameter setting that is selected by and reflective of a user's preferences. In still other instances, the HVAC controller 18 may be configured to receive and/or download firmware and/or hardware updates such as, for example, device drivers from the web server 66 over the network 58. Additionally, the HVAC controller 18 may be configured to receive local weather data, weather alerts and/or warnings, major stock index ticker data, and/or news headlines over the second network 58. These are just some examples.

Depending upon the application and/or where the HVAC user is located, remote access and/or control of the HVAC controller 18 may be provided over the first network 54 and/or the second network 58. A variety of remote, wireless devices 62 may be used to access and/or control the HVAC controller 18 from a remote location (e.g. remote from the HVAC Controller 18) over the first network 54 and/or second network 58 including, but not limited to, mobile phones including smart phones, tablet computers, laptop or personal computers, wireless network-enabled key fobs, e-readers, and/or the like. In many cases, the remote, wireless devices 62 are configured to communicate wirelessly over the first network 54 and/or second network 58 with the HVAC controller 18 via one or more wireless communication protocols including, but not limited to, cellular communication, ZigBee, REDLINK™, Bluetooth, WiFi, IrDA, dedicated short range communication (DSRC), EnOcean, and/or any other suitable common or proprietary wireless protocol, as desired.

In some cases, an application program code (i.e. app) stored in the memory of the remote device 62 may be used to remotely access and/or control the HVAC controller 18 rather than or in addition to a local user interface at the HVAC controller 18. The application program code (app) may be provided for downloading from the external web service hosted by the external web server 66 (e.g. Honeywell's TOTAL CONNECT™ web service) to which the HVAC controller 18 may also be connected or another external web service (e.g. ITUNES or Google Play). In some cases, the app may provide a remote user interface for interacting with the HVAC controller 18 at the user's remote device 62. For example, through the user interface provided by the app, a user may be able to change the operating schedule and operating parameter settings such as, for example, temperature set points, humidity set points, start times, end times, schedules, window frost protection settings, configure or setup the HVAC controller, accept software updates and/or the like. Communications may be routed from the user's remote device 62 to the web server 66 and then, from the web server 66 to the HVAC controller 18. In some cases, communications may flow in the opposite direction such as, for example, when a user interacts directly with the HVAC controller 18 to change an operating parameter setting such as, for example, a schedule change or a set point change. The change made at the local user interface of the HVAC controller 18 may be routed to the web server 66 and then from the web server 66 to the remote device 62 where it may reflected by the application program executed by the remote device 62. In other cases, a user may be able to interact with the HVAC controller 18 via a user interface provided by one or more web pages served up by the web server 66. The user may interact with the one or more web pages using a variety of internet capable devices to effect a change at the HVAC controller 18 as well as view usage data and energy consumption date related to the usage of the HVAC system 4. In still yet another case, communication may occur between the user's remote device 62 and the HVAC controller 18 without being relayed through a server. These are just some examples.

Figure 3:
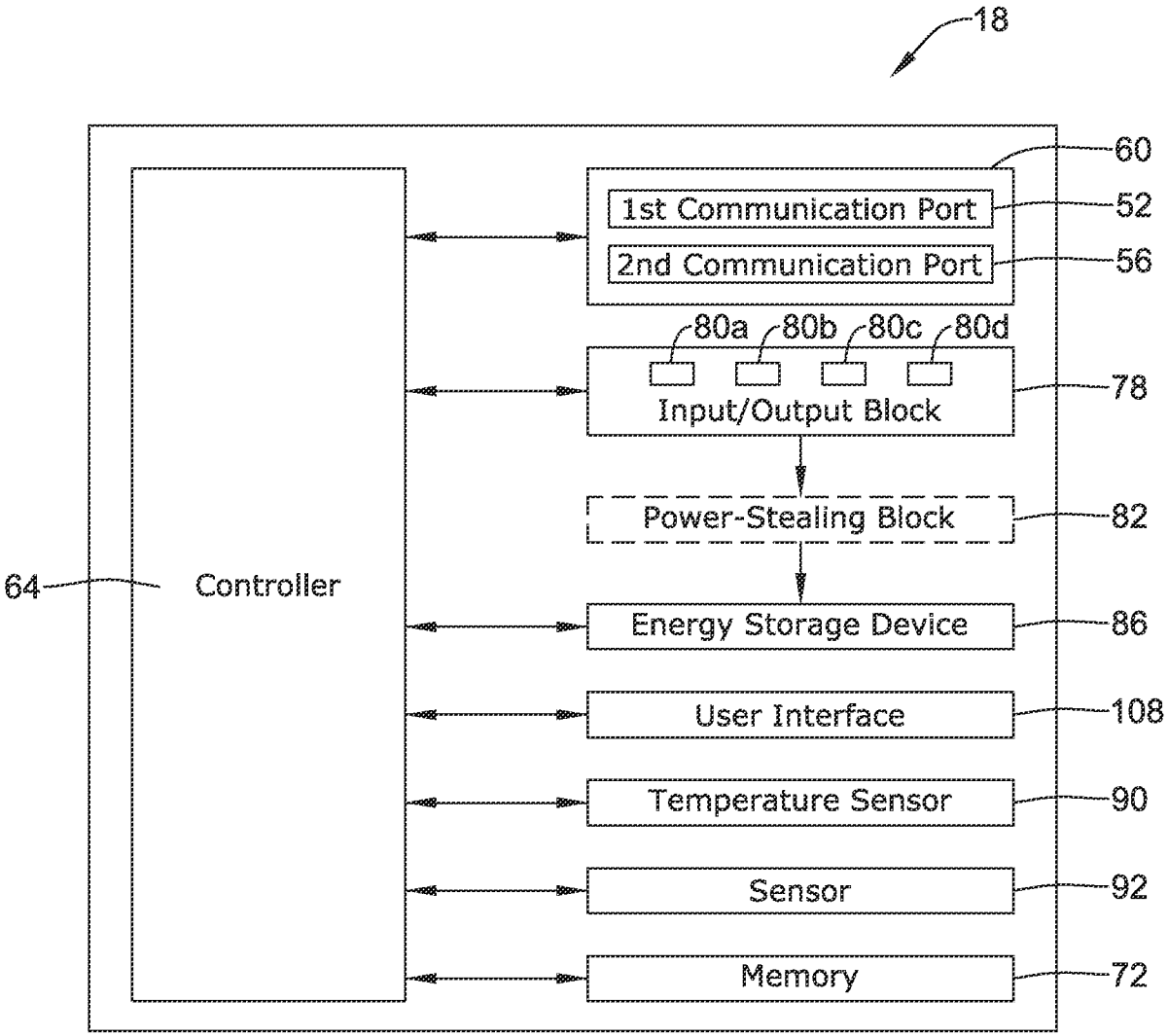
FIG. 3 is a schematic block diagram of an illustrative HVAC controller.

FIG. 3 is a schematic block diagram of illustrative HVAC controller 18. As discussed above with reference to FIG. 2, in some cases, the HVAC controller 18 may be accessed and/or controlled from a remote location over the first network 54 and/or the second network 58 using a remote wireless device 62 such as, for example, a smart phone, a tablet computer, a laptop or personal computer, a wireless network-enabled key fob, an e-reader, and/or the like. When so provided, and as shown in FIG. 3, the HVAC controller 18 may include a communications block 60 having a first communications port 52 for communicating over a first network (e.g. wireless LAN) and a second communications port 56 for communicating over a second network (e.g. WAN or the Internet). The first communications port 52 can be a wireless communications port including a wireless transceiver for wirelessly sending and/or receiving signals over a first wireless network 54. Similarly, the second communications port 56 may be a wireless communications port including a wireless transceiver for sending and/or receiving signals over a second wireless network 58. In some cases, the second communications port 56 may be in communication with a wired or wireless router or gateway for connecting to the second network, but this is not required. In some cases, the router or gateway may be integral to the HVAC controller 18 or may be provided as a separate device. Additionally, the HVAC controller 18 may include a controller (e.g. microcontroller, microcontroller, etc.) 64 and a memory 72. The HVAC controller 18 may also include a local user interface 108, but this is not required. In some cases, HVAC controller 18 may include a timer (not shown). The timer may be integral to the controller 64 or may be provided as a separate component. The memory 72 of the illustrative HVAC controller 18 may be in communication with the controller 64. The memory 72 may be used to store any desired information, such as the aforementioned control algorithm, set points, schedule times, configuration information, diagnostic limits such as, for example, differential pressure limits, delta T limits, and the like. The memory 72 may be any suitable type of storage device including, but not limited to, RAM, ROM, EPROM, flash memory, a hard drive, and/or the like. In some cases, the controller 64 may store information within the memory 72, and may subsequently retrieve the stored information from the memory 72.

In many cases, the HVAC controller 18 may include an input/output block (I/O block) 78 having a number of wire terminals (e.g. 80*a*-80*c*) for receiving one or more wires from the HVAC system 4. The I/O block having four wire terminals, as shown in FIG. 3, is just one example and is not intended to be limiting. Also, while the term I/O may imply both input and output, it is intended to include input only, output only, as well as both input and output. The I/O block 78 may be used to communicate one or more signals to and/or from one or more HVAC components 6 of the HVAC system 4. The HVAC controller 18 may have any number of wire terminals for accepting connections from one or more components 6 of the HVAC system 4. How many and which of the wire terminals are actually used at a particular installation will depend on the particular configuration of the HVAC system 4. Different HVAC systems 4 having different HVAC components and/or types of HVAC components 6. That is, the wiring configuration between the wires of the HVAC system and the wire terminals 80*a*-80*d* of the input/output block 78 may be dependent on the particular HVAC system configuration of the HVAC system 4. In some cases, one or more wire terminals 80*a*-80*d* of the I/O block 78 may communicate with another controller, which is in communication with one or more HVAC components of the HVAC system 4, such as a zone control panel in a zoned HVAC system, equipment interface module (EIM) (e.g. EIM 34 shown in FIG. 1) or any other suitable building control device. In any event, when replacing an old HVAC controller with a new one, the wires that are available in the wall and/or were wired to the old HVAC controller may provide information that can help determine the HVAC configuration of the existing HVAC system 4.

In some cases, the HVAC controller 18 may be powered by line-power connected to one or more of the terminals 80*a*-80*d* of the I/O block 78. In some cases, an optional power-stealing block 82 may be connected to one or more wire terminals of the I/O block 78, and may be configured to bleed or steal power from the one or more wire terminals of the I/O block 78. The power that is stolen may be stored in an energy storage device 86 that may be used to at least partially power the HVAC controller 18. In some cases, the energy storage device 86 may be capacitor or a rechargeable battery. Alternatively, or in addition, the HVAC controller 18 may include a back-up source of energy such as, for example, a battery that may be used to supplement power supplied to the HVAC controller 18 when the amount of available power is less than optimal or is insufficient to power certain applications. Certain applications or functions performed by the HVAC controller 18 may require a greater amount of energy than others. If there is an insufficient amount of energy available, then, in some cases, certain applications and/or functions may be prohibited by the controller 64.

The HVAC controller 18 may include one or more sensors such as for example, a temperature sensor, a humidity sensor, an occupancy sensor, a proximity sensor, and/or the like. In some cases, the HVAC controller 18 may include one or more internal temperature sensor 90, as shown FIG. 3, but this is not required. The HVAC controller 18 may communicate with one or more remote temperature sensors, humidity sensors, and/or occupancy sensors located throughout a building or structure. In some cases, the HVAC controller may communicate with a temperature sensor and/or humidity sensor located outside of the building or structure for sensing an outdoor temperature and/or humidity if desired.

In some cases, the HVAC controller 18 may include a sensor 92 that is configured determine if a user is in proximity to the building controller. In some cases, the sensor 92 may be a motion sensor or a proximity sensor such as, for example, a passive infrared (PIR) sensor. In certain cases in which the sensor 92 is a motion sensor or a proximity sensor, the sensor 92 may be located remotely from the HVAC controller 18 and may be in wireless communication with the HVAC controller 18 via one of the communication ports.

In other cases, the sensor 92 may be configured to determine that the user is near or expected to be near the HVAC controller 18 based, at least in part, on the location data provided by a location based service application program executed by a user's remote device 62 that the user utilizes to interact with the HVAC controller 18 from a remote location. The location data generated by the location based services app may be transmitted from the user's remote device 62 directly to the HVAC controller 18 or, in some cases, may be transmitted to the HVAC controller 18 via a server 66 (e.g. Honeywell's TOTAL CONNECT™ server) to which both the HVAC controller 18 and the user's remote device 62 may be connected. In some cases, the sensor 92 may be configured to determine that the user or, more specifically, the user's remote device 62 has crossed a proximity boundary relative to the location of the HVAC controller 18 based on location data provided by the user's remote device that the user utilizes to interact with the HVAC controller 18. The sensor 92 may determine that the user has crossed a proximity boundary by comparing the location data generated by the user's remote device 62 to a predetermined fix location. In some cases, the proximity boundary may be defined by a radius extending outward from the predetermined fix location, and the predetermined fixed location may be the location of the HVAC controller 18.

In yet another example, the sensor 92 may be configured to determine that the user is in proximity to or is expected to be in proximity to the HVAC controller 18 upon detecting that the user's remote device 62 is connected to the building's wireless network which, in some cases, may be the same network to which the HVAC controller 18 is also connected. Such functionality is shown and described in U.S. application Ser. No. 13/559,443 entitled "HVAC CONTROLLER WITH WIRELESS NETWORK BASED OCCUPANCY DETECTION AND CONTROL", the entirety of which is incorporated by reference herein for all purposes.

In still other cases, the sensor 92 may be configured to determine that a user is in proximity to the HVAC controller 18 upon sensing a user's interaction with the HVAC controller 18 via a local user interface of the HVAC controller 18. For example, the sensor 92 may be configured to sense when the screen of a local user interface 108 is touched and/or when a button provided at the local user interface 108 is pressed by a user. In some cases, the button may be a touch sensitive region provided on the user interface 108 when the user interface 108 incorporates a touch screen display. In other cases, the button may be a hard button or soft key that is provided separate from a display of the user interface 108.

In some cases, upon detecting or determining that a user is in proximity to the HVAC controller, the sensor 92 may deliver a signal to the controller 64 indicating that the user is in proximity to the HVAC controller 18. In other cases, the upon detecting or determining that a user is in proximity to the HVAC controller, the sensor 92 may be configured to transmit a signal to a remote server 66 over a network 58 via the communications block 60.

The local user interface 108, when provided, may be any suitable user interface that permits the HVAC controller 18 to display and/or solicit information, and in some cases, accept one or more user interactions with the HVAC controller 18. For example, the user interface 108 may permit a user to locally enter data such as temperature set points, humidity set points, starting times, ending times, schedule times, configuration information, diagnostic limits, responses to alerts, and the like. In one embodiment, the user interface 108 may be a physical user interface that is accessible locally at the HVAC controller 18, and may include a display and/or a distinct keypad. The display may be any suitable display. In some instances, a display may include or may be a liquid crystal display (LCD), and in some cases a fixed segment display or a dot matrix LCD display. In other cases, the user interface 108 may be a touch screen LCD panel that functions as both display and keypad. The touch screen LCD panel may be adapted to solicit values for a number of operating parameters and/or to receive such values, but this is not required. In still other cases, the user interface 108 may be a dynamic graphical user interface.

In some instances, the user interface 108 need not be physically accessible to a user locally at the HVAC controller 18. Instead, the user interface 108 may be a remote virtual user interface 108 that is accessible via the first network 54 and/or second network 58 using a mobile wireless device such as one of those remote devices 62 previously described herein. In some cases, the remote virtual user interface 108 may be provided by an app exacted by a user's remote device for the purposes of remotely interacting with the HVAC controller 18. Through the virtual user interface 108 provided by the app on the user's remote device 62, the user may make change temperature set points, humidity set points, starting times, ending times, schedule times, configuration changes, diagnostic limits, respond to alerts, update their user profile, view energy usage data, and/or the like. Any changes made by a user to the HVAC controller 18 via a remote virtual user interface 108 provided by an app on the user's remote device 62 may be first transmitted to an external web server 66. The external web server 66 may receive and accept the user inputs entered via the remote virtual user interface 108 provided by the app on the user's remote device 62, and associate the user inputs with a user's account on the external web service. If the user inputs include any changes to the existing control algorithm including any temperature set point changes, humidity set point changes, schedule changes, start and end time changes, window frost protection setting changes, operating mode changes, configuration changes, and/or changes to a user's profile, the external web server 66 may update the control algorithm, as applicable, and transmit at least a portion of the updated control algorithm over the second network 58 to the HVAC controller 18 where it is received via the second port 56 and may be stored in the memory 72 for execution by the controller 64. In some cases, the user may observe the effect of their inputs at the HVAC controller 18.

In some cases, the virtual user interface 108 may include one or more web pages that are sent over the second network 58 (e.g. WAN or the Internet) by an external web server (e.g. web server 66). The one or more web pages forming the virtual user interface 108 may be hosted by an external web service and associated with a user account having one or more user profiles. The external web server 66 may receive and accept any user inputs entered via the virtual user interface and associate the user inputs with a user's account on the external web service. If the user inputs include changes to the existing control algorithm including any temperature set point changes, humidity set point changes, schedule changes, start and end time changes, window frost protection setting changes, operating mode changes, configuration changes, and/or changes to a user's profile, the external web server 66 may update the control algorithm, as applicable, and transmit at least a portion of the updated control algorithm over the second network 58 to the HVAC controller 18 where it is received via the second port 56 and may be stored in the memory 72 for execution by the controller 64. In some cases, the user may observe the effect of their inputs at the HVAC controller 18.

In some cases, a user may utilize one or more of the local user interface 108 provided at the HVAC controller 18 and/or a virtual user interface 108 as described herein. The two types of user interfaces 108 that may be used to interact with the HVAC controller 18 are not mutually exclusive of one another. However, in some cases, a virtual user interface 108 may provide more advanced capabilities to the user.

Figure 4:
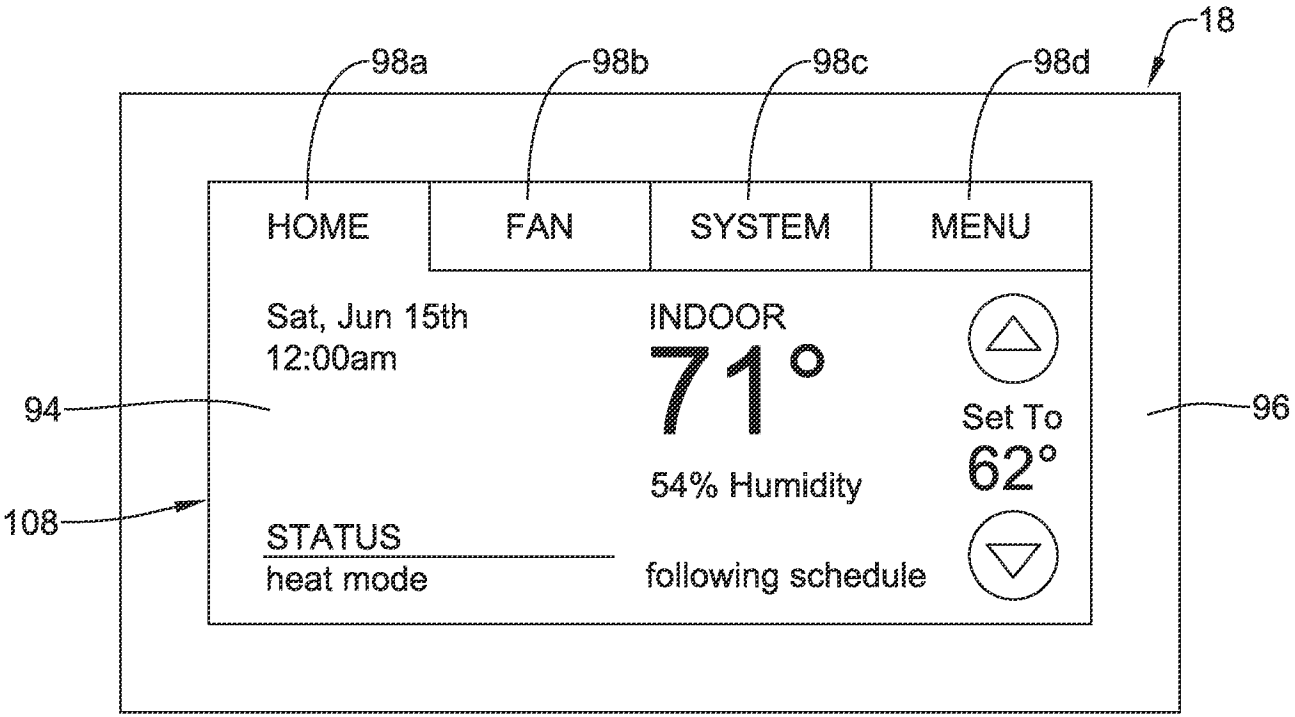
FIG. 4 is a front, schematic view of an illustrative HVAC controller.

FIG. 4 is a front view of an illustrative HVAC controller 18 including a local user interface 108 at the HVAC controller 18. The local user interface 108 provided at the HVAC controller 18 may be in addition to, or in alternative to, a virtual user interface that may be provided by an application program executed by a user's remote device 62 or that may be viewed as one or more web pages served up by a web server 66, as discussed herein. As shown in FIG. 4, the local user interface 108 may include a display 94 housed by a housing 96. In some cases, the display 94 may be a touch screen display 94. The touch screen display 94 may include one or more touch sensitive regions (e.g. 98*a*-98*d*) corresponding to one or more selectable options that a user may select when interacting with the HVAC controller 18. FIG. 4 shows an exemplary Home screen that may be displayed on the display 94 when in use. While the local user interface 108 that is provided at the HVAC controller 18 is capable of receiving a user's interactions, a more advanced or detailed remote virtual user interface 108 for accessing and/or changing even more information may be provided by an application program executed at a user's remote device 62 or by one or more web pages served up by a web server such as web server 66, as described herein.

Referring back to FIG. 3, the controller 64 may operate in accordance with an algorithm that controls or at least partially controls one or more HVAC components of an HVAC system such as, for example, HVAC system 4 shown in FIG. 1. The controller 64, for example, may operate in accordance with a control algorithm that provides temperature set point changes, humidity set point changes, schedule changes, start and end time changes, window frost protection setting changes, operating mode changes, and/or the like. At least a portion of the control algorithm may be stored locally in the memory 72 of the HVAC controller 18 and, in some cases, may be received from an external web service over the second network 58. The control algorithm (or portion thereof) stored locally in the memory 72 of the HVAC controller 18 may be periodically updated in accordance with a predetermined schedule (e.g. once every 24 hours, 48 hours, 72 hours, weekly, monthly, etc.), updated in response to any changes to the control algorithm made by a user, and/or updated in response to a user's request. The updates to the control algorithm or portion of the control algorithm stored in the memory 72 may be received from an external web service over the second network. In some cases, the control algorithm may include settings such as set points.

In some cases, the controller 64 may operate according to a first operating mode having a first temperature set point, a second operating mode having a second temperature set point, a third operating mode having a third temperature set point, and/or the like. In some cases, the first operating mode may correspond to an occupied mode and the second operating mode may correspond to an unoccupied mode. In some cases, the third operating mode may correspond to a holiday or vacation mode wherein the building or structure in which the HVAC system 4 is located may be unoccupied for an extended period of time. In other cases, the third operating mode may correspond to a sleep mode wherein the building occupants are either asleep or inactive for a period of time. These are just some examples. It will be understood that the controller 64 may be capable of operating in additional modes as necessary or desired. The number of operating modes and the operating parameter settings associated with each of the operating modes may be established locally through a user interface, and/or through an external web service and delivered to the HVAC controller via the second network 58 where they may be stored in the memory 72 for reference by the controller 64.

In some cases, the controller 64 may operate according to one or more predetermined operating parameter settings associated with a user profile for an individual user. The user profile may be stored in the memory 72 of the HVAC controller 18 and/or may be hosted by an external web service and stored on an external web server. The user profile may include one or more user-selected settings for one or more operating modes that may be designated by the user. For example, the controller 64 may operate according to a first operating mode having a first temperature set point associated with a first user profile, a second operating mode having a second temperature set point associated with the first user profile, a third operating mode having a third temperature set point associated with the first user profile, and/or the like. In some cases, the first operating mode may correspond to an occupied mode, the second operating mode may correspond to an unoccupied mode, and the third operating mode may correspond to a vacation or extended away mode wherein the building or structure in which the HVAC system 4 is located may be unoccupied for an extended period of time. In some cases, multiple user profiles may be associated with the HVAC controller 18. In certain cases where two or more user profiles are associated with the HVAC controller 18, the controller 64 may be programmed to include a set of rules for determining which individual user profile takes precedence for controlling the HVAC system when both user profiles are active.

In some cases, the controller 64 may be programmed to execute a guided set-up routine that may guide a user through configuring the HVAC controller 18 to control one or more components 6 of their particular HVAC system 4. In some cases, the user may have limited knowledge about the particular HVAC system configuration. The guided set-up routine may be configured to guide a user through set-up of the HVAC controller 18 without requiring detailed knowledge of the particular HVAC system and/or without requiring the user to consult a technical manual or guide.

When executing the guided set-up routine, the controller 64 may be configured to display two or more screens via a user interface 108 that may guide a user through one or more steps necessary to configure the HVAC controller 18. In some cases, at least one of the screens may display one or more options that identifies an HVAC configuration setting and that further identifies a wiring configuration that is associated with or corresponds to the HVAC configuration setting. The wiring configuration between the wires of the HVAC system 4 and the wire terminals 80*a*-80*d* of the output block 78 of the HVAC controller 18 may be dependent on the particular HVAC system configuration of the HVAC system 4. When replacing an old HVAC controller with a new one, the wires that are available in the wall and/or were wired to the old HVAC controller provide information that may help determine the HVAC configuration of the HVAC system 4.

The one or more options that are displayed may be available for selection by a user through the user interface 108 (local user interface and/or remote virtual user interface), and may relate to a variety of HVAC configuration settings including, but not limited to: a type of heating and/or cooling equipment included in the particular HVAC system 4; a number of heating or cooling equipment stages such as, for example, single stage, two stage, and variable firing rate; a backup heat source; a changeover valve; a compressor; and/or the like. The user may select the appropriate HVAC setting based, at least in part, on the identified wiring configuration associated with the various displayed options. In many instances, the controller 64 does not automatically detect a wire connected to a terminal 80*a*-80*d* of the input/output block 78. The controller 64 may be programmed to control the one or more components 6 of the HVAC system 4 based on the option selected by the user via the guided set-up routine.

FIGS. 5-18 provide several examples of illustrative screens that may be displayed to the user on the display of a local user interface of an HVAC controller 18 and/or a remote virtual user interface, during set-up of an HVAC controller 18. In some cases, the one or more screens may guide a user through one or more steps necessary to configure the HVAC controller 18 to control a particular HVAC system 4 having a particular HVAC system configuration. In some cases, the particular sequence in which the various screens are displayed to the user and/or which screens are displayed may be dependent upon the user's response to a previous screen. For example, and referring to FIG. 5, if the user does not select the cooling option displayed on screen 150, then the controller 64 may be programmed to exclude any subsequent screens that relate to cooling equipment from the sequence of subsequent screens that may be displayed to the user during set-up of the HVAC controller 18.

In other cases, the sequence is a fixed sequence of predetermined screens that may be displayed to the user in a particular order. The user may utilize a button to advance from a first screen in the sequence to the last screen in the sequence, and each of the screens are displayed regardless of the user's response to a prompt provided on a previous screen. If the displayed screen is not applicable to the user's particular system, the user may advance through the sequence to the next applicable screen through selection of an appropriate button provided for this purpose.

Figure 5:
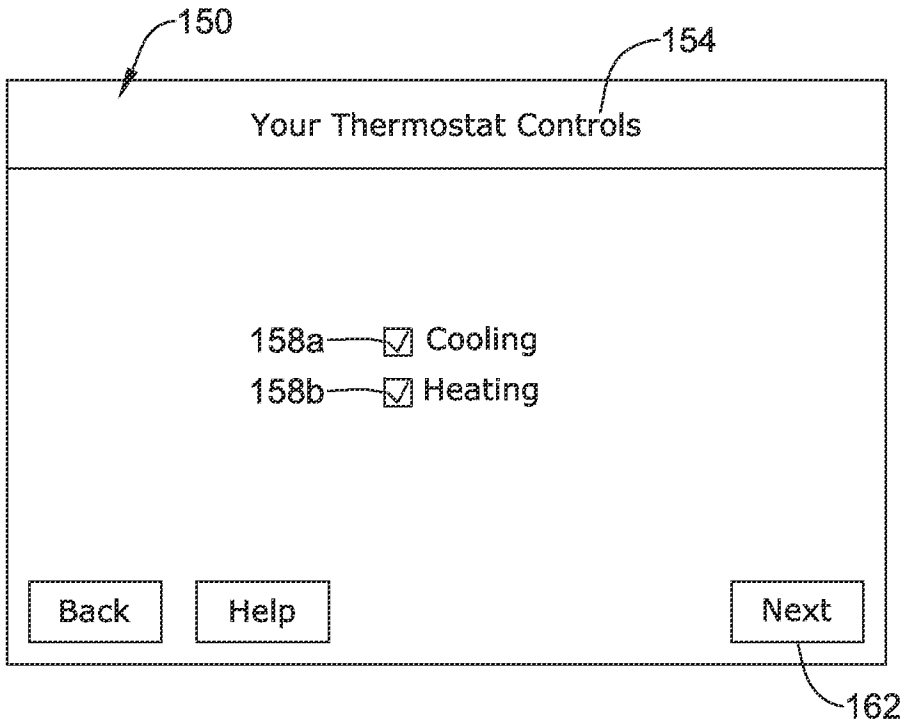
FIG. 5-18 provide examples of illustrative screens that may be displayed to a user during a set-up process of the HVAC controller.

FIG. 5 shows an example of a first screen 150 that may be displayed to a user on the display of a user interface 108 upon initiation of a set-up routine for configuring an HVAC controller 18 to control one or more components of a particular HVAC system 4. As shown in FIG. 5, screen 150 may include a user prompt 154 that prompts the user to identify what type of system the HVAC controller 18 is intended to control. In some cases, screen 150 may include one or more selectable options 158*a*, 158*b* that the user may select to indicate whether or not the HVAC controller 18 is intended to control a cooling system, a heating system, or both a heating and cooling system. In some cases, more than one option may be selected. For example, as shown in FIG. 5, both the cooling option 158*a* and the heating option 158*b* are selected indicating that the HVAC controller 18 will control and HVAC system having both heating and cooling HVAC components 6. The selectable options 158*a*, 158*b* may be displayed simultaneously on a common screen, as shown, or on separate screens, as desired.

In other cases, instead of prompting the user to select an option corresponding to their system type, screen 150 may include a user query that queries the user about a heating and/or cooling system. For example, screen 150 may query the user "Do you have heating?" and may provide "yes" and "no" checkboxes for selection by the user to indicate their system type. After indicating their HVAC system type through selection of the one or more selectable options 158*a*, 158*b*, the user may advance to the next applicable screen in the sequence through selection of a button such as, for example, NEXT button 162 provided for this purpose.

Figure 6:
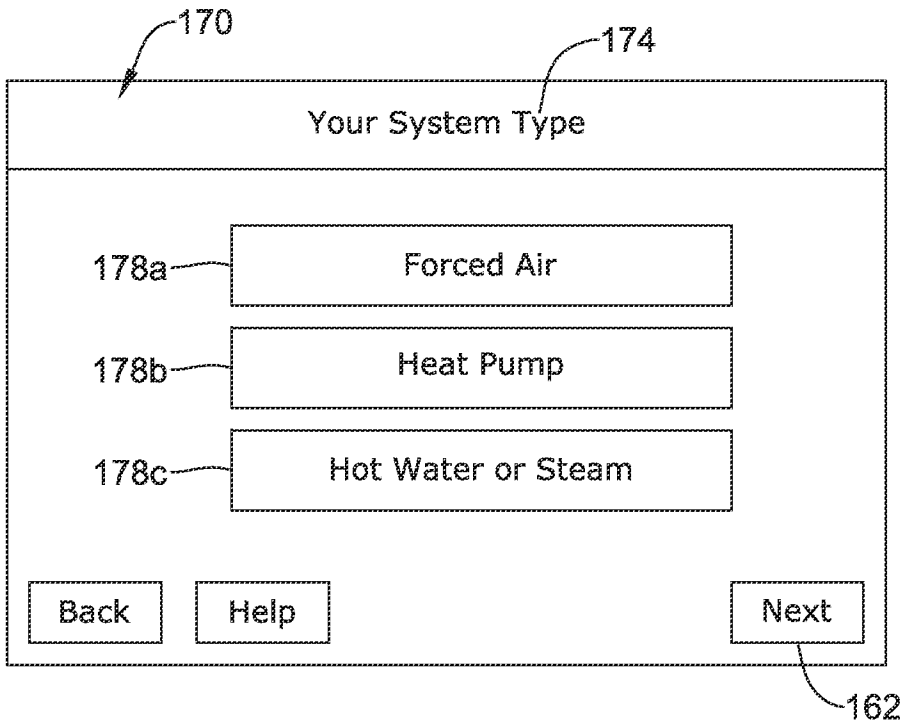

FIG. 6 shows an exemplary screen 170 that may be displayed in response to receiving an input from a user indicating that the HVAC controller is intended to control a heating system. As shown in FIG. 6, screen 170 may include a user prompt 174 that prompts a user to identify the type of heating equipment that the HVAC controller 18 is intended to control. In addition, screen 170 may include one or more selectable options 178*a*-178, each selectable option corresponding to a different type of heating system. For example, screen 170 may include: a first selectable option 178*a* corresponding to a forced air heating system; a second selectable option 178*b* corresponding to a heat pump heating system; and a third selectable option 178*c* corresponding to a hot water or steam heating system. These are just some examples.

Figure 7:
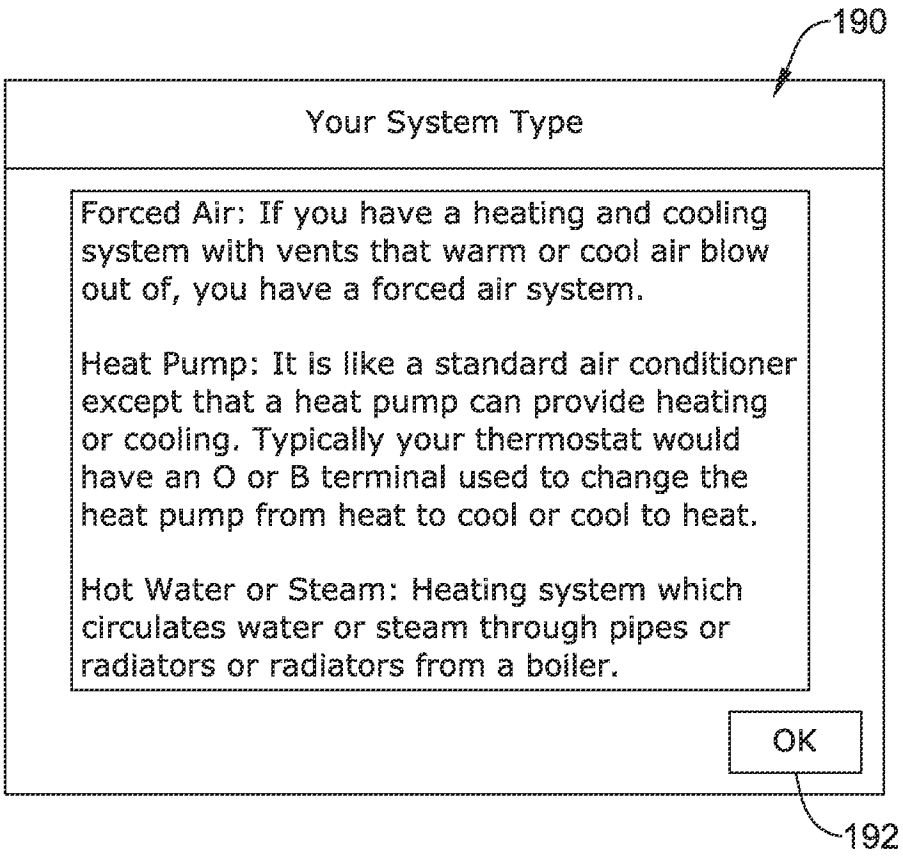

In some cases, a HELP button 182 may be provided that, when selected by the user, may cause an additional screen 190, as shown in FIG. 7, to be displayed that may provide additional information about each of the different types of heating systems available for selection by a user through screen 170. In some cases, screen 190 may be provided as a separate screen. In other cases, screen 190 may be provided as a pop-up window or floating window that may be displayed over screen 170. In the illustrative embodiment shown, the user may return to screen 170 through selection of an OK button 192 or other similar button.

Figure 8:
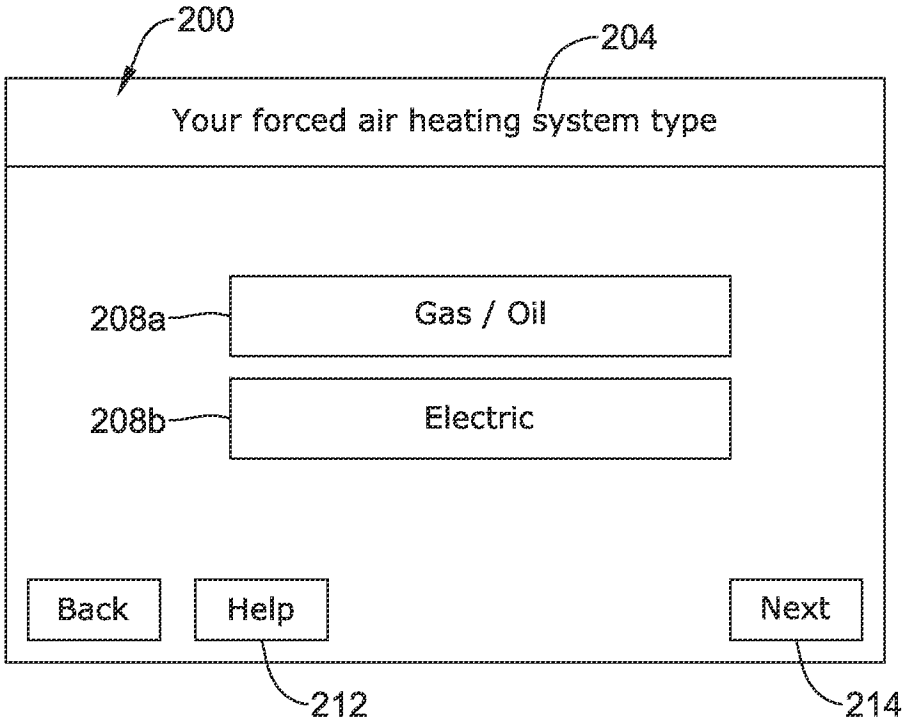
Figure 9:
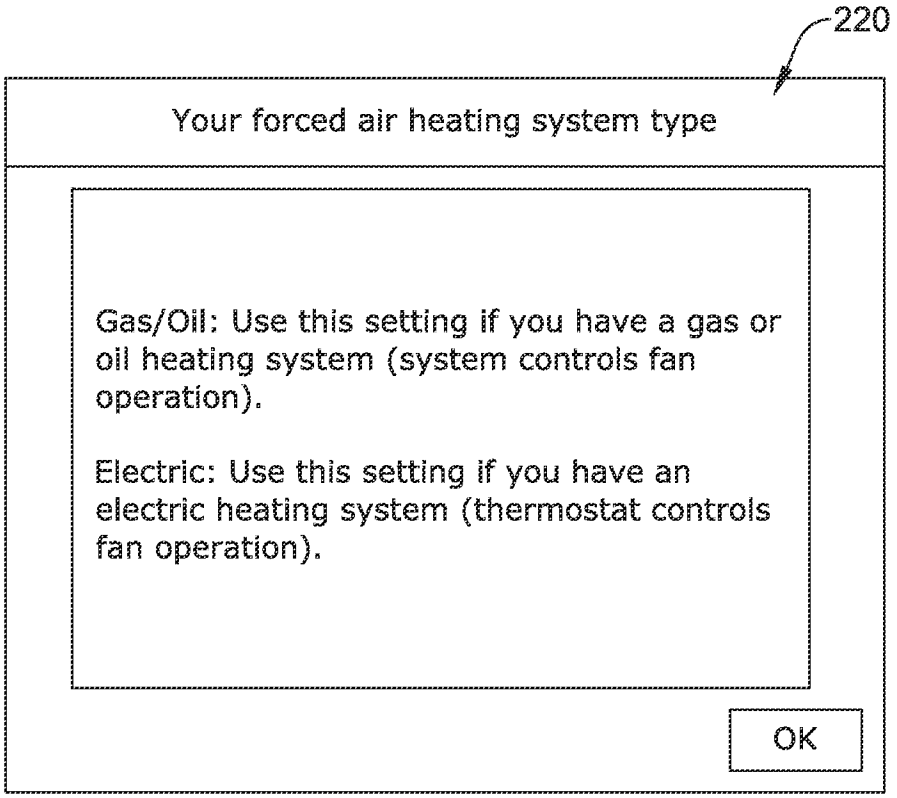

FIG. 8 shown an exemplary screen 200 that may be displayed in response to the user having selected the selectable option 178*a* corresponding to a forced air heating system through screen 170. As shown in FIG. 8, screen 200 may include a user prompt 204 that may prompt a user to identify the type of forced air heating system (gas/oil or electric) that the HVAC controller 18 is intended to control. In addition, screen 200 may include one or more selectable options 208*a*, 208*b*, each option 208*a*, 208*b* corresponding to a type of forced air heating system. For example, screen 200 may include a first selectable option 208*a* corresponding to a gas/oil type of forced air heating system, and a second selectable option 208*b* corresponding to an electric forced air heating system. In some cases, a HELP button 212 may be provided that, when selected by the user, may cause an additional screen 220, as shown in FIG. 9, to be displayed that may provide additional information about each of the different types of forced air heating systems available for selection by a user through screen 200. In some cases, screen 220 may be provided as a separate screen. In other cases, screen 220 may be provided as a pop-up window or floating window that may be displayed over screen 200. The user may return to screen 200 through selection of an OK button 214 or other similar button.

Figure 10:
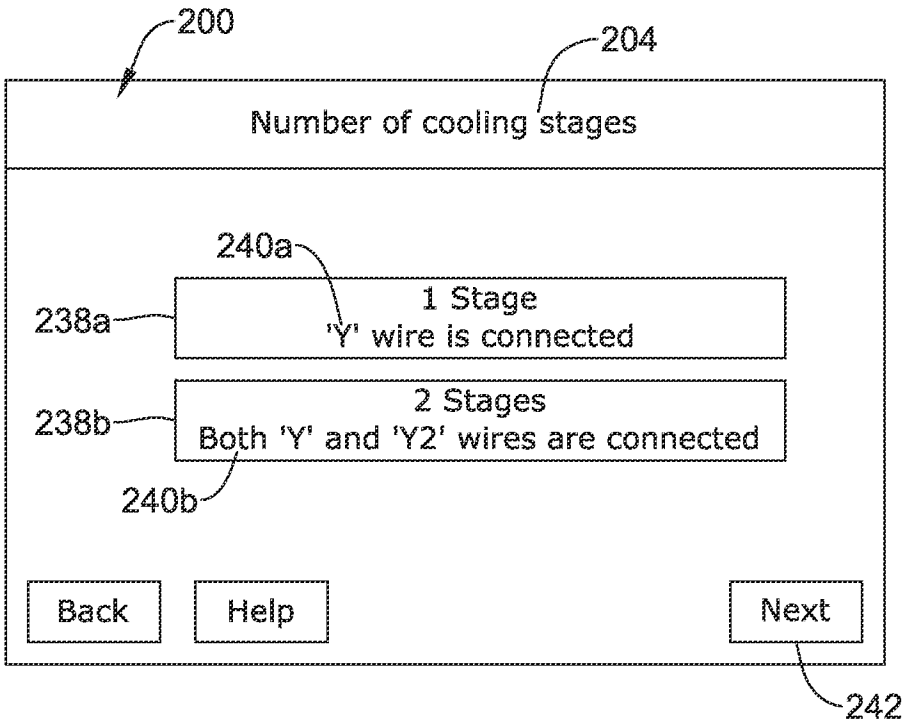

FIG. 10 shows an exemplary screen 230 that may be displayed through which a user may indicate a number of cooling stages that the HVAC controller 18 is intended to control. In some cases, screen 230 may be displayed in response to the user having selected the selectable option 208*a* or 208*b* though screen 200 shown in FIG. 8. As shown in FIG. 10, screen 230 may include a user prompt 234 that may prompt the user to identify the number of cooling stages (the user having previously indicated that the HVAC system includes a cooling component through screen 150 shown in FIG. 5). In addition, screen 230 may include one or more selectable options 238*a*, 238*b*, each option corresponding to a number of cooling stages. For example, as shown in FIG. 10, screen 230 may include a first selectable option 238*a* corresponding to a single cooling stage and a second selectable option 238*b* corresponding to two cooling stages. In some cases, each of the selectable options 238*a*, 238*b* corresponding to the number of cooling stages may include a brief description 240*a*, 240*b* identifying a wiring configuration associated with the particular number of stages. For example, selectable option 238*a* corresponding to a single cooling stage includes a short text sting indicating to the user that the Y (Yellow) wire leading from the HVAC system 4 is connected to the terminal labeled "Y" on the I/O block of the HVAC controller 18. Similarly, selectable option 238*b* corresponding to two cooling stages includes a short text string indicating to the user that both the Y and the Y2 wires are connected to the Y and Y2 terminals on the I/O block of the HVAC controller 18. Alternatively, or in addition to providing text strings, it is contemplated that wiring diagrams and/or pictures of an I/O block with the Y or Y and Y2 wires connected may be provided or linked to the appropriate selectable options 238*a*, 238*b*. In some cases, a user (typically a do-it-yourself homeowner) installing a new HVAC controller 18 may have limited knowledge about the configuration of their existing HVAC system 4, including the number of cooling stages in their HVAC system. This additional description facilitates selection of the appropriate number of cooling stages by a user based on which wires from the HVAC system 4 are connected to terminals on the I/O block of the new HVAC controller 18. After indicating the number of cooling stages through selection of the one or more selectable options 238*a*, 238*b*, the user may advance to the next applicable screen in the sequence through selection of a button such as, for example, NEXT button 242 provided for this purpose.

Figure 11:
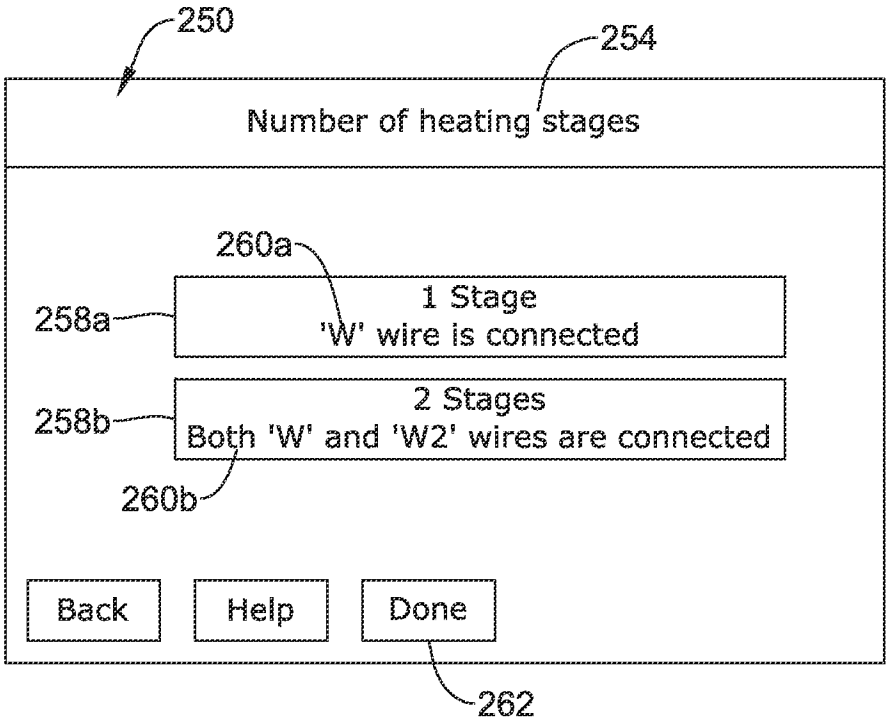

FIG. 11 shows an exemplary screen 250 that may be displayed through which a user may indicate a number of heating stages that the HVAC controller 18 is intended to control. In some cases, screen 250 may be displayed in response to the user having selected the selectable option 208*a* or 208*b* though screen 200 shown in FIG. 8. As shown in FIG. 10, screen 250 may include a user prompt 254 that may prompt the user to identify the number of heating stages (the user having previously indicated that the HVAC system includes a heating component through screen 150 shown in FIG. 5). In addition, screen 250 may include one or more selectable options 258*a*, 258*b*, each option corresponding to a number of heating stages. For example, as shown in FIG. 11, screen 250 may include a first selectable option 258*a* corresponding to a single heating stage and a second selectable option 258*b* corresponding to two heating stages. In some cases, each of the selectable options 258*a*, 258*b* corresponding to the number of heating stages may include a brief description 260*a*, 260*b* identifying a wiring configuration associated with the particular number of stages. For example, selectable option 258*a* corresponding to a single heating stage includes a short text sting indicating to the user that the W (White) wire leading from the HVAC system 4 is connected to the terminal labeled "W" on the I/O block of the HVAC controller 18. Similarly, selectable option 258*b* corresponding to two heating stages includes a short text string indicating to the user that both the W and the W2 wires are connected to the W and W2 terminals on the I/O block of the HVAC controller 18. Alternatively, or in addition to providing text strings, it is contemplated that wiring diagrams and/or pictures of an I/O block with the W or W and W2 wires connected may be provided or linked to the appropriate selectable options 258*a*, 258*b*. In some cases, a user (typically a do-it-yourself homeowner) installing a new HVAC controller 18 may have limited knowledge about the configuration of their existing HVAC system 4, including the number of heating stages in their HVAC system. This additional description facilitates selection of the appropriate number of heating stages by a user based on which wires from the HVAC system 4 are connected to terminals on the I/O block of the new HVAC controller 18. After indicating the number of heating stages through selection of the one or more selectable options 258*a*, 258*b*, the user may select a DONE button 262 to that, when selected by the user, may cause the controller 64 to complete the set-up process.

Figure 12:
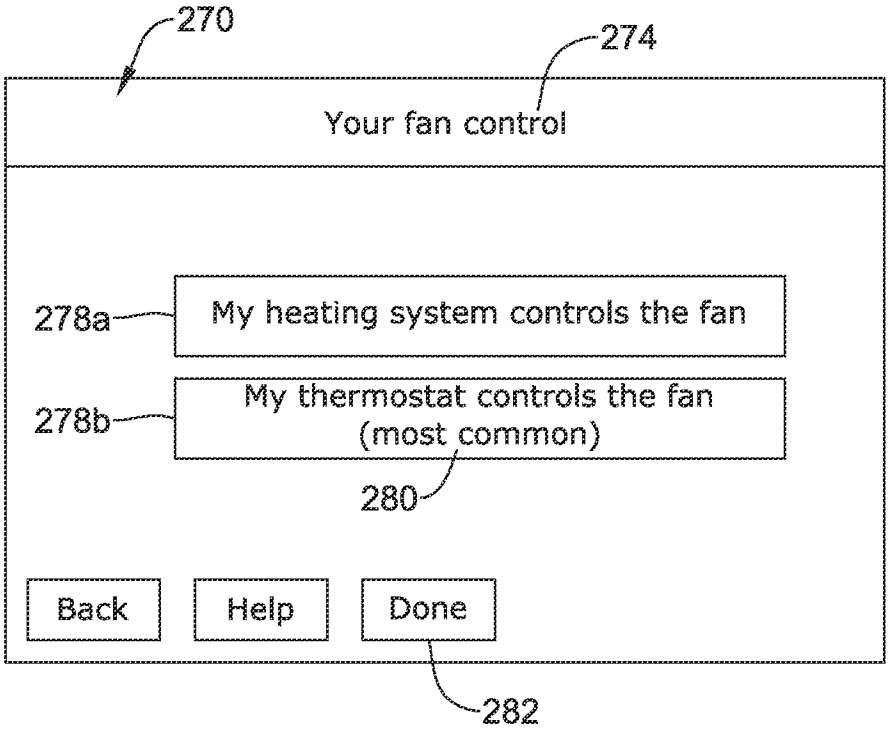

FIG. 12 shows an example screen 270 that may be displayed in setting up fan control of an HVAC system. In some cases, screen 270 may be displayed in addition to screens 230 and/or 250 related to the number of cooling and/or heating stages. As shown in FIG. 12, screen 270 includes a user prompt 274 that prompts the user to identify which of the heating system or thermostat controls the fan. In addition, screen 270 may include one or more selectable options 278*a*, 278*b*, each option 278*a*, 278*b* corresponding to a different mechanism through which the fan may be controlled. For example, as shown in FIG. 12, screen 270 may include a first selectable option 278*a* for indicating that the heating system will control the fan (i.e. through a furnace control board), and a second selectable option 278*b* for indicating that the HVAC controller 18 will control the fan. In addition, at least one of the selectable options 278*a*, 278*b* may include an indicator 280 indicating which mechanism is the most common for controlling the fan. The indicator 280 may be a short text string, as shown in FIG. 12, or may be an asterisk, a dot, or other similar notation that may be provided to indicate to the user that the option (in this case selectable option 278*b*) is the most common option. In some cases, a short text sting may be provided that indicates to the user that a fan wire (e.g. G wire) leading from the HVAC system 4 is connected to the fan terminal on the I/O block of the HVAC controller 18. In some cases, the user may select a DONE button 282 to that, when selected by the user, may cause the controller 64 to complete the set-up process.

Figure 13:
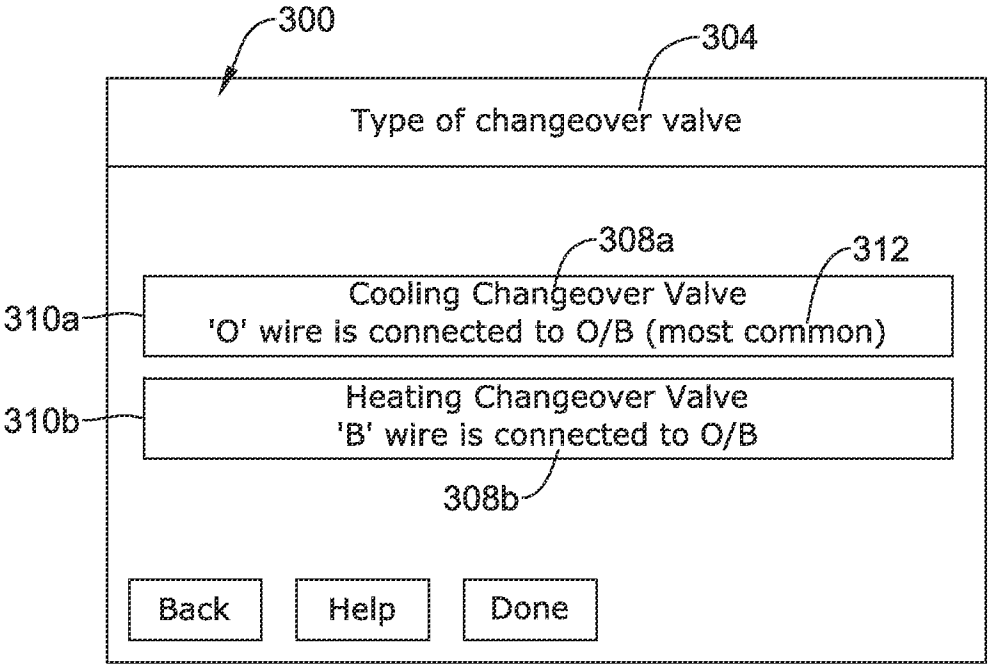

FIG. 13 shows an example screen 300 related to a changeover valve that may be displayed in connection with selection by a user of selectable option 178*b* corresponding to heat pump system through screen 170 shown in FIG. 6. As shown in FIG. 13, screen 300 may include a user prompt 304 that may prompt the user to identify the type of changeover valve associated with the heat pump system. In addition, screen 300 may include one or more selectable options 308*a*, 308*b*, each option corresponding to a type of changeover valve. For example, screen 300 may include a first selectable option 308*a* corresponding to a cooling changeover valve and a second selectable option 308*b* corresponding to a heating cooling changeover valve. In some cases, each of the selectable options 308*a*, 308*b* corresponding to the different types of changeover valves (e.g. heating or cooling) may include a brief description 310*a*, 310*b* identifying a wiring configuration associated with the particular changeover valve. For example, selectable option 308*a* corresponding to cooling changeover valve may include a short text sting 310*a* indicating to the user that the O wire from the HVAC system 4 is connected to the O/B terminal of the HVAC controller 18. Similarly, selectable option 308*b* corresponding to a heating changeover valve may include a short text string 310*b* indicating to the user that the B wire from the HVAC system 4 is connected to the O/B terminal of the HVAC controller 18. This additional description is intended to facilitate selection of the appropriate changeover valve by a user based on which wire(s) from the HVAC system are connected to terminal(s) on the HVAC controller 18.

Figure 14:
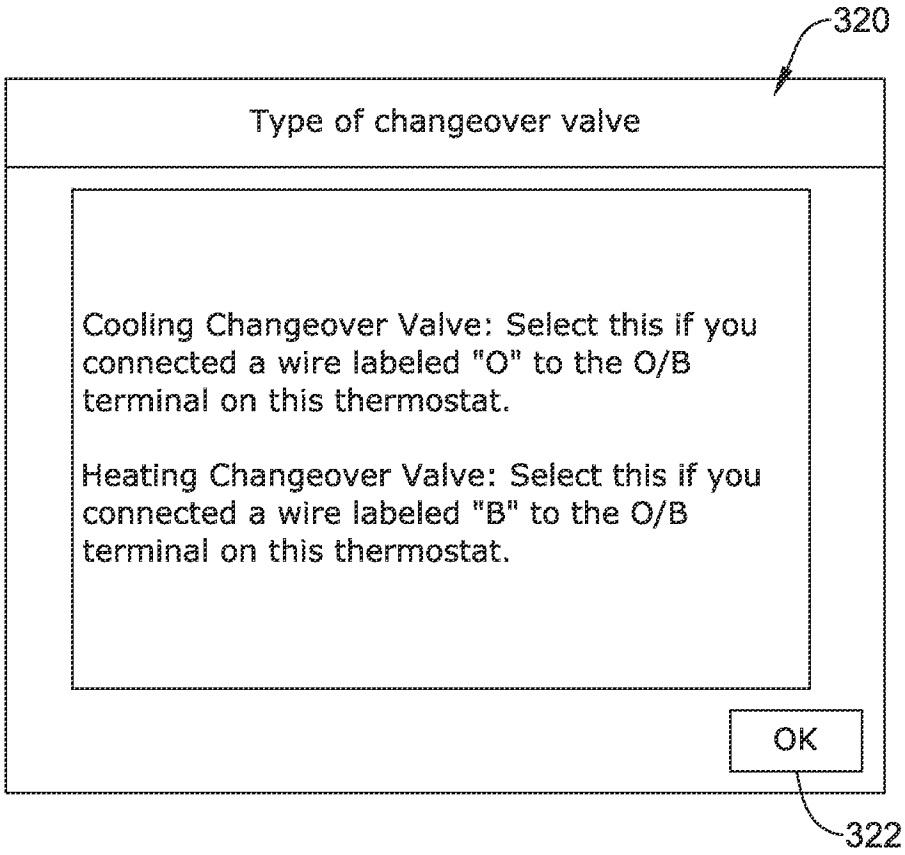

In some cases, at least one of the selectable options 308*a*, 308*b* may include an indicator 312 indicating which configuration setting is the most common. The indicator 312 may be a short text string, as shown in FIG. 13, or may be an asterisk, a dot, or other similar notation that may be provided to indicate to the user that the particular option (in this case selectable option 308*a*) is the most common option. In some cases, a HELP button 314 may be provided that, when selected by the user, may cause an additional screen 320, as shown in FIG. 14, to be displayed that may provide additional information about the different wiring configurations that may be associated with the different changeover valves. In some cases, screen 320 may be provided as a separate screen. In other cases, screen 320 may be provided as a pop-up window or floating window that may be displayed over screen 300. The user may return to screen 300 through selection of an OK button 322 or other similar button.

Figure 15:
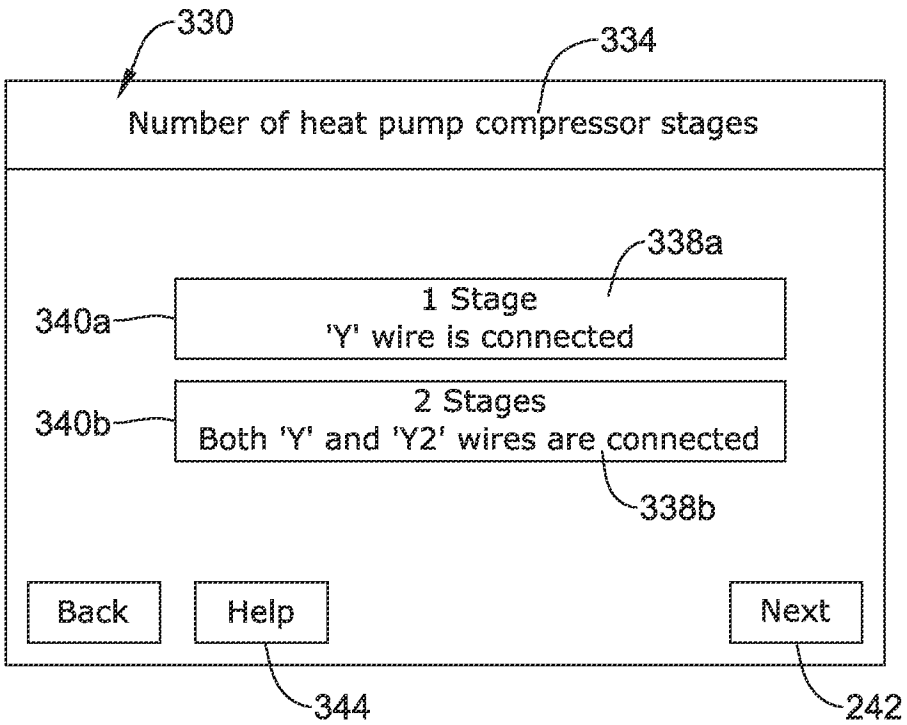
Figure 16:
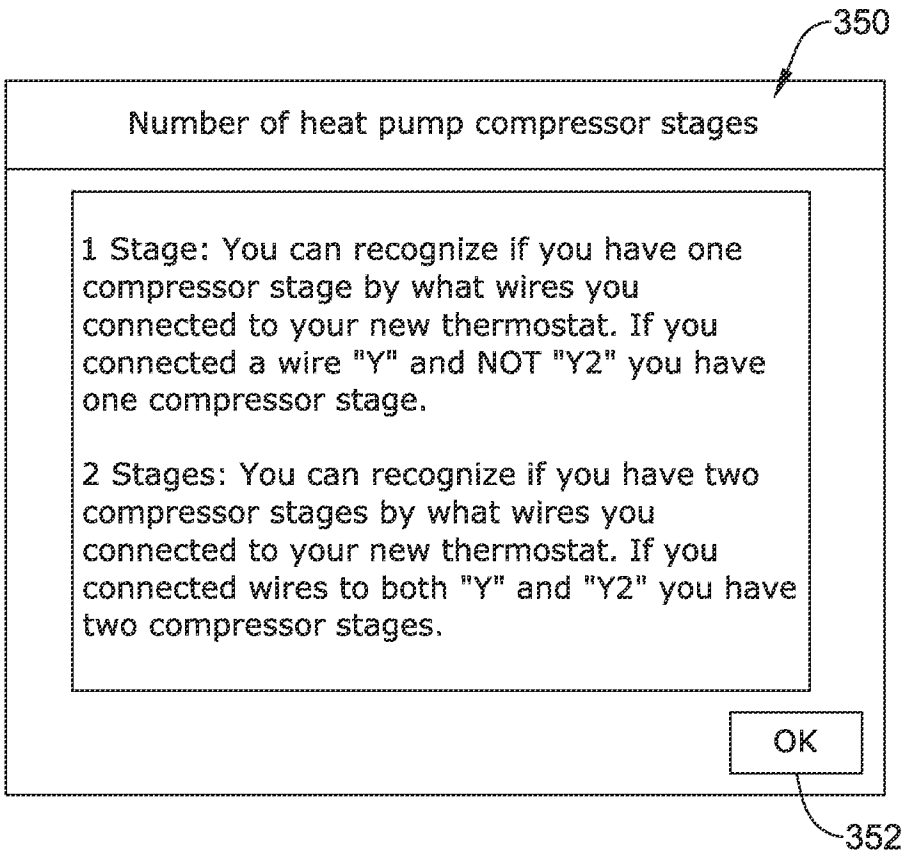

FIG. 15 shows another example screen 330 that may be displayed in connection with selection by a user of selectable option 178*b* corresponding to heat pump system through screen 170 shown in FIG. 6. As shown in FIG. 15, screen 330 may include a user prompt 334 that may prompt the user to identify the number of heat pump compressor stages. In addition, screen 330 may include one or more selectable options 338*a*, 338*b*, each option corresponding to a number of heat pump compressor stages. For example, as shown in FIG. 16, screen 330 may include a first selectable option 338*a* corresponding to a single heat pump compressor stage and a second selectable option 338*b* corresponding to two heat pump compressor stages. In some cases, each of the selectable options 338*a*, 338 corresponding to the number of heat pump compressor stages may include a brief description 340*a*, 340*b* identifying a wiring configuration associated with the particular number of compressor stages. For example, selectable option 338*a* corresponding to a single compressor stage includes a short text sting indicating to the user that the Y wire from the HVAC system 4 is connected to a terminal on the HVAC controller 18. Similarly, selectable option 338*b* corresponding to a two compressor stages includes a short text string indicating to the user that both the Y and the Y2 wires from the HVAC system 4 are connected to wire terminals provided on the HVAC controller 18. This additional description is intended to facilitate selection of the appropriate number of heat pump compressor stages by a user based on which wires from the HVAC system 4 are connected to terminals on the HVAC controller 18. In some cases, a HELP button 344 may be provided that, when selected by the user, may cause an additional screen 350, as shown in FIG. 16, to be displayed that may provide additional information about the different wiring configurations that may be associated with the different heat pump compressor stages. In some cases, screen 350 may be provided as a separate screen. In other cases, screen 350 may be provided as a pop-up window or floating window that may be displayed over screen 330. The user may return to screen 330 through selection of an OK button 352 or other similar button. After indicating the number of heat pump compressor stages through selection of the one or more selectable options 338*a*, 338*b*, the user may advance to the next applicable screen in the sequence through selection of a button such as, for example, NEXT button 342, provided for this purpose.

Figure 17:
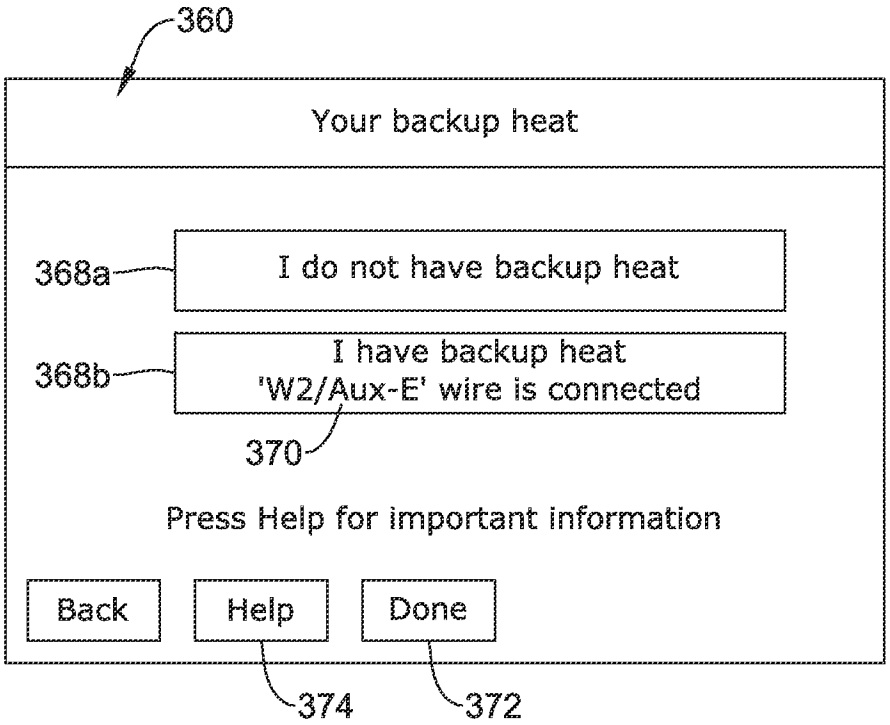
Figure 18:
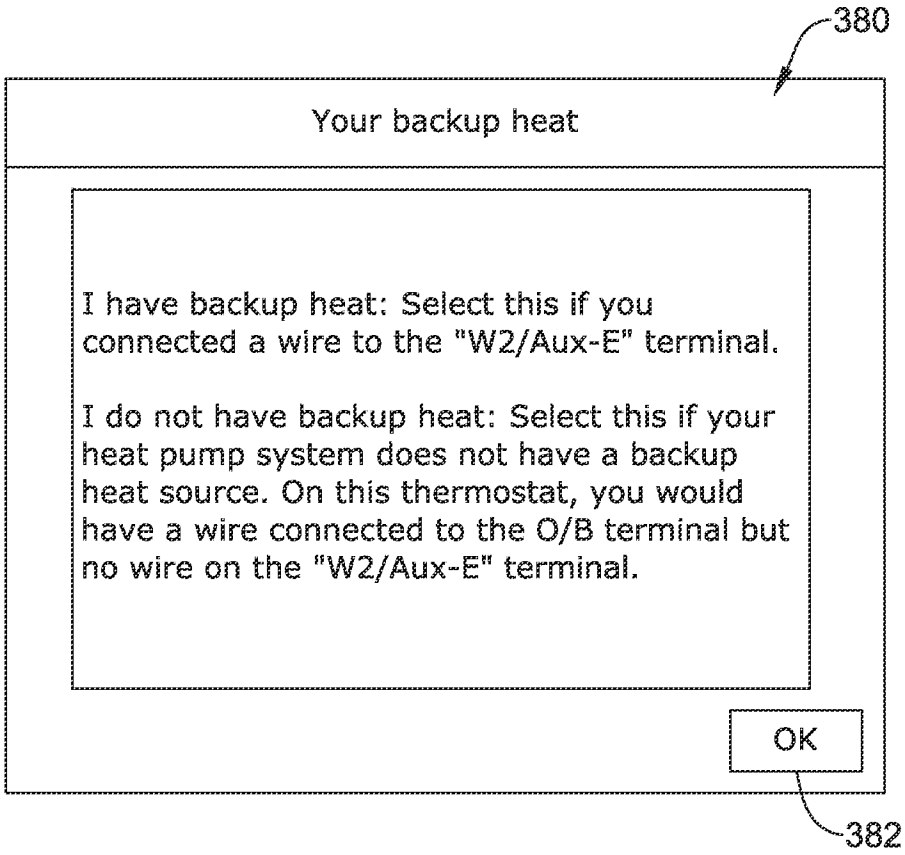

FIG. 17 shows another example screen 360 that may be displayed in connection with selection by a user of selectable option 178*b* corresponding to heat pump system through screen 170 shown in FIG. 6. As shown in FIG. 17, screen 360 may include a user prompt 364 that may prompt the user to indicate whether or not the HVAC system includes backup heat. In addition, as shown in FIG. 17, screen 360 may include a first selectable option 368*a* for indicating that the HVAC system does not have backup heat and a second selectable option 368*b* for indicating that the HVAC system includes backup heat. In some cases, at least one of the selectable options 368*a* 368*b* for indicating whether or not the HVAC system includes backup heat may include a brief description 370 identifying a wiring configuration associated with backup heat. For example, selectable option 368*b* indicating that the HVAC system includes backup heat includes a short text sting indicating to the user that the W2/Aux-E wire is connected to a terminal on the HVAC controller 18. This additional description is intended to help the user identify whether or not the HVAC system includes backup heat. In some cases, a HELP button 374 may be provided that, when selected by the user, may cause an additional screen 350, as shown in FIG. 18, to be displayed that may provide additional description of the wiring configuration associate with backup heat that may help the user identify whether or not the HVAC system includes backup heat. In some cases, screen 380 may be provided as a separate screen. In other cases, screen 380 may be provided as a pop-up window or floating window that may be displayed over screen 350. The user may return to screen 350 through selection of an OK button 382 or other similar button. After indicating whether or not the HVAV system includes backup heat through selection of the one or more selectable options 368*a*, 368*b*, the user may select a DONE button 372 to that, when selected by the user, may cause the controller 64 to complete the set-up process.

While FIGS. 5-18 are described as they relate to an HVAC controller 18 including a user interface having a display, as shown in FIG. 4, it will be generally understood that the same or a similar set of screens may be displayed on the display of a user interface of a user's remote device by an application program code that may be used for configuring an HVAC controller to control one or more components of an HVAC system. The app may provide a remote user interface 108 for interacting with the HVAC controller 18. Such an app may be available for download from a web service such as for, example, Honeywell's TOTAL CONNECT™ web service of Apple, Inc.'s ITUNES or Google's Google Play. In addition, the same or a similar set of screens may be displayed via one or more web pages served up by a web server such as, for example, web server 66 shown in FIG. 2, and may be accessed and viewed over a network via the user interface of any number of web-enabled devices including a user's smart phone, tablet, laptop or personal computer, an e-reader, and/or a web-enabled HVAC controller 18. The one or more web pages served up by the server may be available through a web-service such as, for example, Honeywell's TOTAL CONNECT™ web service, and may also provide a remote user interface 108 for interacting with the HVAC controller 18.

Having thus described several illustrative embodiments of the present disclosure, those of skill in the art will readily appreciate that yet other embodiments may be made and used within the scope of the claims hereto attached. Numerous advantages of the disclosure covered by this document have been set forth in the foregoing description. It will be understood, however, that this disclosure is, in many respect, only illustrative. Changes may be made in details, particularly in matters of shape, size, and arrangement of parts without exceeding the scope of the disclosure. The disclosure's scope is, of course, defined in the language in which the appended claims are expressed.

What is claimed is:

1. An HVAC controller configured to control one or more components of an HVAC system having a particular HVAC system configuration, the HVAC controller comprising:

a user interface including a display;

a memory;

an output block configured to provide one or more control signals to the HVAC system, the output block having a number of wiring terminals for accepting wires of the HVAC system, the wiring configuration between the wires of the HVAC system and the wiring terminals of the output block is dependent on the particular HVAC system configuration of the HVAC system;

a controller operatively coupled to the memory, the user interface and the output block, the controller configured to display one or more configuration screens used to configure the HVAC controller for controlling the particular HVAC system configuration, wherein at least one of the screens simultaneously displays a first selectable option and a second selectable option, wherein the first selectable option and the second selectable option is for at least one of a number of cooling stages, a number of heating stages, a number of heat pump compressor stages, or identifying backup heat, and wherein the controller does not detect a wire connected to the output block;

wherein the first selectable option comprises a user prompt with a first text string asking a user to identify if a first particular wire of the HVAC system is connected to the output block of the HVAC controller;

wherein the second selectable option comprises a user prompt with a second text string asking the user to identify if a second particular wire of the HVAC system is connected to the output block of the HVAC controller, the second particular wire is different from the first particular wire; and the controller configures the HVAC controller to control the particular HVAC system configuration based at least in part on whether the first particular wire and second particular wire were identified as being present.

2. The HVAC controller of claim 1, wherein when selected, the first selectable option configures the HVAC controller to control a one stage HVAC system.

3. The HVAC controller of claim 2, wherein the first particular wire corresponds to a "Y" wire of the HVAC system.

4. The HVAC controller of claim 2, wherein when selected, the second selectable option configures the HVAC controller to control a two stage HVAC system.

5. The HVAC controller of claim 4, wherein the second particular wire corresponds to a "Y2" wire of the HVAC system.

6. The HVAC controller of claim 1, wherein:

when selected, the first selectable option configures the HVAC controller to not control a backup heat source of the HVAC system; and when selected, the second selectable option configures the HVAC controller to control a backup heat source of the HVAC system.

7. The HVAC controller of claim 6, wherein the second particular wire corresponds to a backup heat wire of the HVAC system.

8. The HVAC controller of claim 1, comprising displaying an image or diagram of the output block in conjunction with the first selectable option and/or the second selectable option.

9. The HVAC controller of claim 1, comprising displaying a video in conjunction with the first selectable option and/or the second selectable option.

10. The HVAC controller of claim 1, wherein at least one of the first selectable option and the second selectable option relate to a backup heat source included in the particular HVAC system configuration of the HVAC system.

11. The HVAC controller of claim 1, wherein at least one of the first selectable option and the second selectable option relate to the number of cooling stages or the number of heating stages.

12. The HVAC controller of claim 1, wherein the user prompt of the first selectable option, when selected, indicates that the user confirms that the first particular wire of the HVAC system is present for connection to the output block of the HVAC controller.

13. An HVAC controller configured to control one or more components of an HVAC system having a particular HVAC system configuration, the HVAC controller comprising:

a user interface including a display;

a memory;

an output block configured to provide one or more control signals to the HVAC system, the output block having a number or wiring terminals for accepting wires of the HVAC system, the wiring configuration between the wires of the HVAC system and the wiring terminals of the output block is dependent on the particular HVAC system configuration of the HVAC system;

a controller operatively coupled to the memory, the user interface and the output block, the controller configured to display a guided-set up routine on the display comprising two or more screens that guide a user to configure the HVAC controller to control the particular HVAC system configuration of the HVAC system, wherein the guided-set up routine solicits information from a user by providing one or more user prompts, wherein the one or more user prompts include a plurality of text strings that asks the user to identify an equipment type contained in the particular HVAC system configuration as well as confirm a wiring configuration identified by the user as having been used to wire the HVAC system to the wiring terminals of the output block of the HVAC controller, wherein a first text string of a user prompt of the one or more user prompts asks the user to identify if a first wire from the HVAC system is connected to the output block of the HVAC controller and a second text string of the user prompt of the one or more user prompts asks the user to identify if a second wire from the HVAC system is connected to the output block of the HVAC controller, and wherein the controller does not detect a wire connected to the output block; and the controller configured to use the equipment type identified by the user as being contained in the particular HVAC system configuration as well the wiring configuration identified by the user as having been used to wire the HVAC system to the wiring terminals of the output block to configure the HVAC controller to control the particular HVAC system configuration of the HVAC system.

14. The HVAC controller of claim 13, wherein the guided-set up routine simultaneously displays the first text string and the second text string on a common screen.

15. The HVAC controller of claim 13, wherein the equipment type identified by the user as being contained in the particular HVAC system configuration comprises one or more of forced air, hot water, steam, heat pump, changeover valve, compressor, backup heat, single stage, two stage, and variable fire rate.

* * * * *